US007357478B2

(12) United States Patent
Usuda et al.

(10) Patent No.: US 7,357,478 B2
(45) Date of Patent: Apr. 15, 2008

(54) LIQUID EJECTION APPARATUS AND METHOD FOR CONTROLLING LIQUID EJECTION APPARATUS

(75) Inventors: Hidenori Usuda, Nagano-ken (JP); Norihiro Maruyama, Nagano-ken (JP); Kazutoshi Shimizu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 11/339,538

(22) Filed: Jan. 26, 2006

(65) Prior Publication Data

US 2006/0192822 A1 Aug. 31, 2006

(30) Foreign Application Priority Data

Jan. 26, 2005 (JP) ..... 2005-018776
May 17, 2005 (JP) ..... 2005-144278

(51) Int. Cl.
*B41J 2/165* (2006.01)

(52) U.S. Cl. ..... 347/29; 347/6; 347/7; 347/14; 347/19; 347/85

(58) Field of Classification Search ..... None
See application file for complete search history.

(56) References Cited

U.S. PATENT DOCUMENTS 6,082,851 A * 7/2000 Shihoh et al. ..... 347/85
6,733,114 B2 * 5/2004 Kobayashi et al. ..... 347/85

FOREIGN PATENT DOCUMENTS

| | | | |
|---|---|---|---|
| JP | 8-310082 | A | 11/1996 |
| JP | 10-146989 | A | 6/1998 |
| JP | 10-193628 | A | 7/1998 |
| JP | 11-348300 | A | 12/1999 |
| JP | 2000-190525 | A | 7/2000 |
| JP | 2001-199079 | A | 7/2001 |
| JP | 2001-253084 | A | 9/2001 |
| JP | 2001-253085 | A | 9/2001 |
| JP | 2002-178498 | A | 6/2002 |
| JP | 2004-255658 | A | 9/2004 |

* cited by examiner

*Primary Examiner*—Lamson Nguyen
*Assistant Examiner*—Justin Seo
(74) *Attorney, Agent, or Firm*—Sughrue Mion, PLLC

(57) ABSTRACT

An air pressurization pump is driven to apply pressurized air pressure to a main tank storing ink. The pressurized air causes the ink to be supplied from the main tank to a recording head arranged on a carriage. A CPU of an inkjet recording apparatus selectively sets a drive control mode and a power saving control mode. The drive control mode operates the air pressurization pump, and the power saving control mode consumes less power than the drive control mode. If the drive control mode ends, the CPU shifts to the power saving control mode when a predetermined time elapses after the drive control mode ends and stops operating the gas pressurization pump.

11 Claims, 13 Drawing Sheets

LIQUID EJECTION APPARATUS AND METHOD FOR CONTROLLING LIQUID EJECTION APPARATUS

BACKGROUND OF THE INVENTION

The present invention relates to a liquid ejection apparatus for ejecting liquid as droplets with a liquid ejection head, such as an inkjet recording apparatus, a display manufacturing apparatus, an electrode formation apparatus, or a biochip manufacturing apparatus, and to a method for controlling such a liquid ejection apparatus.

An inkjet recording apparatus is known in the prior art as a liquid ejection apparatus that ejects liquid droplets from a nozzle of an ejection head. One type of such an inkjet recording apparatus (hereafter referred to as a "recording apparatus") includes a main tank located apart from its carriage and is referred to as an off-carriage type recording apparatus.

Such type of an inkjet recording apparatus may be used for business purposes. To print in relatively large quantities, a business purpose inkjet recording apparatus includes a plurality of large-capacity main tanks and sub tanks corresponding to the main tanks. The sub-tanks are arranged on a carriage, which includes a recording head functioning as an ejection head. Ink is supplied from each main tank to the corresponding sub tank via an ink supply tube and then to the recording head from the sub tank.

A large-size recording apparatus having a long carriage scanning distance is designed for performing printing on large papers. To improve the throughput, the recording head of a large-size recording apparatus includes an increased number of nozzles. The recording apparatus needs a plurality of ink supply tubes corresponding to a plurality of colors of ink to connect its main tanks to sub tanks, which are arranged on the carriage. Due to the long carriage scanning distance of such a recording apparatus, the ink supply tubes connecting the main tanks and the sub tanks are inevitably long. Further, due to the increased number of nozzles in the recording head, the recording apparatus consumes a large amount of ink. As a result, the kinetic pressure of ink in each ink supply tube connecting the main tank and the sub tank increases. This may cause the amount of ink supplied to each sub tank to become insufficient.

An inkjet recording apparatus having a structure for supplying a sufficient amount of ink to each sub tank has been proposed. This inkjet recording apparatus applies air pressure to each main tank, and generates a forced flow of ink from each main tank to each sub tank.

Such type of a recording apparatus includes an air pressurization pump, which applies pressurized air to each main tank, and a pressure detector, which detects the air pressure applied to each main tank. Based on a control signal provided from a host computer, the recording apparatus drives or stops the air pressurization pump in accordance with the pressure detected by the pressure detector during printing, nozzle cleaning, or flushing. This supplies a sufficient amount of ink to each sub tank during printing, nozzle cleaning, or flushing.

When waiting for input of a control signal during a standby state, the recording apparatus drives or stops the air pressurization pump based on the pressure detected by the pressure detector. As a result, a sufficient amount of ink is supplied to each sub tank even during a standby state.

Peripherals connected to the host computer conventionally are provided with functions for entering a power saving control mode (low power consumption mode) to reduce power consumption. The peripherals shift to the power saving control mode when a standby state in which no control signal is input from the host computer continues for at least a predetermined time or when a command to shift to the power saving control mode is provided from the user.

The power saving control mode is specified in detail by the Energy Star standard.

Japanese Laid-Open Patent Publication No. 2004-255658 describes a power saving control mode based on the Energy Star standard but does not mention an air pressurization pump. Japanese Laid-Open Patent Publication No. 10-193628 describes a sleep mode and a refresh operation but does not mention the driving of an air pressurization pump system. Japanese Laid-Open Patent Publication No. 8-310082 describes a power saving function of a printer but does not mention the driving of an air pressurization pump system.

The prior art recording apparatus described above drives or stops the air pressurization pump based on the pressure detected by the pressure detector when waiting for an input of a control signal from the host computer during the standby mode. With this structure, when the recording apparatus is not receiving a control signal instructing printing or other operations from the host computer and the air pressurization pump is not being driven, the air pressure may decrease before a predetermined time for waiting for input of a control signal elapses during the standby state. In this case, the decreased pressure is detected by the pressure detector, and the air pressurization pump is driven based on the detected pressure.

In this manner, the pressure detector and the air pressurization pump does not always operate in a coordinated manner in the prior art. Thus, power-reduction measures have not been taken in this respect.

As a result, the recording apparatus including the prior art air pressurization pump does not satisfy the requirements for a power saving control mode.

The recording apparatus is given above as an example. However, the problem of failing to satisfy the power saving control occurs in other liquid ejection apparatuses that eject liquid droplets with a liquid ejection head when an air pressurization pump is driven based on the detected value of a pressure detector during a standby state. Examples of such other liquid ejection apparatuses include a display manufacturing apparatus, an electrode formation apparatus, and a biochip manufacturing apparatus.

SUMMARY OF THE INVENTION

It is an object of the present invention to provide a liquid ejection apparatus and a method for controlling a liquid ejection apparatus that satisfies the requirements of the power saving control mode.

One aspect of the present invention is a method for controlling a liquid ejection apparatus that supplies liquid stored in a tank to a liquid ejection head arranged on a carriage by applying pressurized gas pressure to the tank. The method includes performing a pressurization sequence for operating a gas pressurization pump when the pressurized gas pressure applied to the tank decreases and for stopping the operation of the gas pressurization pump when the pressurized gas pressure increases, and selectively setting a drive control mode and a power save control mode. The drive control mode supplies the liquid from the tank to the liquid ejection head by applying the pressurized gas pressure to the tank through the pressurization sequence, and the power saving control mode consumes less power than the drive control mode. The method further includes shifting to the power saving control mode when a predetermined time elapses after the drive control mode ends and stops operating the gas pressurization pump, without the gas pressurization pump being operated by the pressurization sequence until the predetermined time elapses.

Another aspect of the present invention is a method for controlling a liquid ejection apparatus that supplies liquid stored in a tank to a liquid ejection head arranged on a carriage by applying pressurized gas pressure to the tank, in which the liquid ejection apparatus includes a capping unit for sealing the liquid ejection head when necessary. The method includes performing a pressurization sequence for operating a gas pressurization pump when the pressurized gas pressure applied to the tank decreases and for stopping the operation of the gas pressurization pump when the pressurized gas pressure increases, and selectively setting a drive control mode and a power save control mode. The drive control mode supplies the liquid from the tank to the liquid ejection head by applying the pressurized gas pressure to the tank through the pressurization sequence, and the power saving control mode consumes less power than the drive control mode. The method further includes shifting to the power saving control mode when a predetermined time elapses after the drive control mode ends and the capping unit seals the liquid ejection head, without the gas pressurization pump being operated by the pressurization sequence until the predetermined time elapses.

A further aspect of the present invention is a liquid ejection apparatus including a tank for storing liquid, a gas pressurization pump for applying pressurized gas pressure to the tank, a liquid ejection head arranged on a carriage, and a controller for controlling the supply of the liquid to the liquid ejection head from the tank. The controller performs a pressurization sequence for operating the gas pressurization pump when the pressurized gas pressure decreases and for stopping the operation of the gas pressurization pump when the pressurized gas pressure increases. The controller further selectively sets a drive control mode and a power save control mode. The drive control mode supplies the liquid from the tank to the liquid ejection head by applying the pressurized gas pressure to the tank through the pressurization sequence, and the power saving control mode consumes less power than the drive control mode. The controller also shifts to the power saving control mode when a predetermined time elapses after the drive control mode ends and stops operating the gas pressurization pump, without the gas pressurization pump being operated by the pressurization sequence until the predetermined time elapses.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A liquid ejection apparatus according to a first embodiment of the present invention will now be described with reference to FIGS. 1 to 13. The liquid ejection apparatus is embodied in an inkjet recording apparatus including an off-carriage ink supply system.

Figure 1:
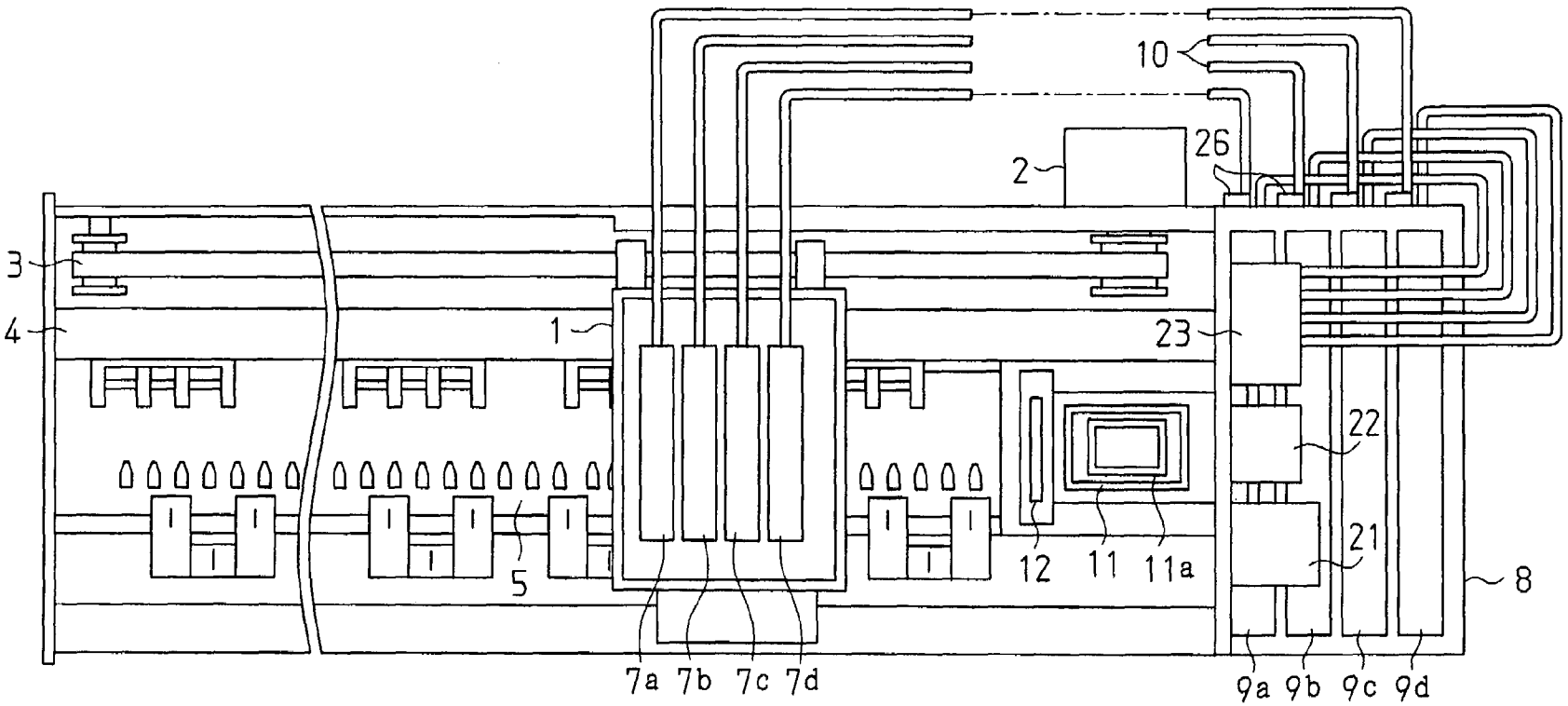
FIG. 1 is a schematic plan view of an inkjet recording apparatus according to a first embodiment of the present invention.

FIG. 1 is a plan view showing the basic structure of the inkjet recording apparatus. A timing belt 3, which is driven by a carriage motor 2, reciprocally moves a carriage 1 in a main scanning direction. A scanning guide member 4 guides the movement of the carriage 1. The main scanning direction corresponds to the longitudinal direction of a paper feeder 5, or the widthwise direction of a sheet of recording paper. Although not shown in FIG. 1, an inkjet recording head 6 (refer to FIG. 2) is installed on a surface of the carriage 1 facing the paper feeder 5.

A plurality of sub tanks 7*a* to 7*d* for supplying the recording head 6 with ink in the colors of black, yellow, magenta, and cyan are arranged in the carriage 1. The four sub tanks 7*a* to 7*d* temporarily store the corresponding colors of ink. Main tanks 9*a* to 9*d* corresponding to the sub tanks 7*a* to 7*d* are arranged as ink cartridges in a cartridge holder 8, which is arranged at an end portion of the apparatus. Ink in the colors of black, yellow, magenta, and cyan are supplied to the recording head 6 from the main tanks 9*a* to 9*d* through flexible ink supply tubes 10. The ink supply tubes 10 form an ink supply system.

A capping unit 11 for sealing the surface of the recording head 6, on which nozzles are formed (nozzle surface), is arranged in a non-print area (home position) lying along the movement path of the carriage 1. The capping unit 11 includes an upper surface on which a cap member 11*a* is arranged. The cap member 11*a* is made of a flexible material, such as rubber, to seal the nozzle surface of the recording head 6. When the carriage 1 is moved to the home position, the cap member 11*a* seals the nozzle surface of the recording head 6.

For example, the carriage 1 is moved to the home position when printing is completed so that the cap member 11*a* seals the nozzle surface of the recording head 6. When sealing the nozzle surface of the recording head 6 when the recording apparatus is in a sleep state, the cap member 11*a* of the capping unit 11 functions as a cap for preventing the nozzle holes from drying.

Further, one end of a tube connected to a suction pump (tube pump) is connected to the cap member 11*a* (not shown). In a cleaning mode, negative pressure generated by the suction pump is applied to the recording head 6 to perform a cleaning operation for drawing ink out of the nozzles of the recording head 6.

Further, a wiping member 12 is arranged at a position adjacent to the capping unit 11 in a print area. The wiping member 12 is made from an elastic material, such as rubber. The wiping member 12 wipes and cleans the nozzle surface of the recording head 6 when necessary. The recording head 6 functions as a liquid ejection head.

Figure 2:
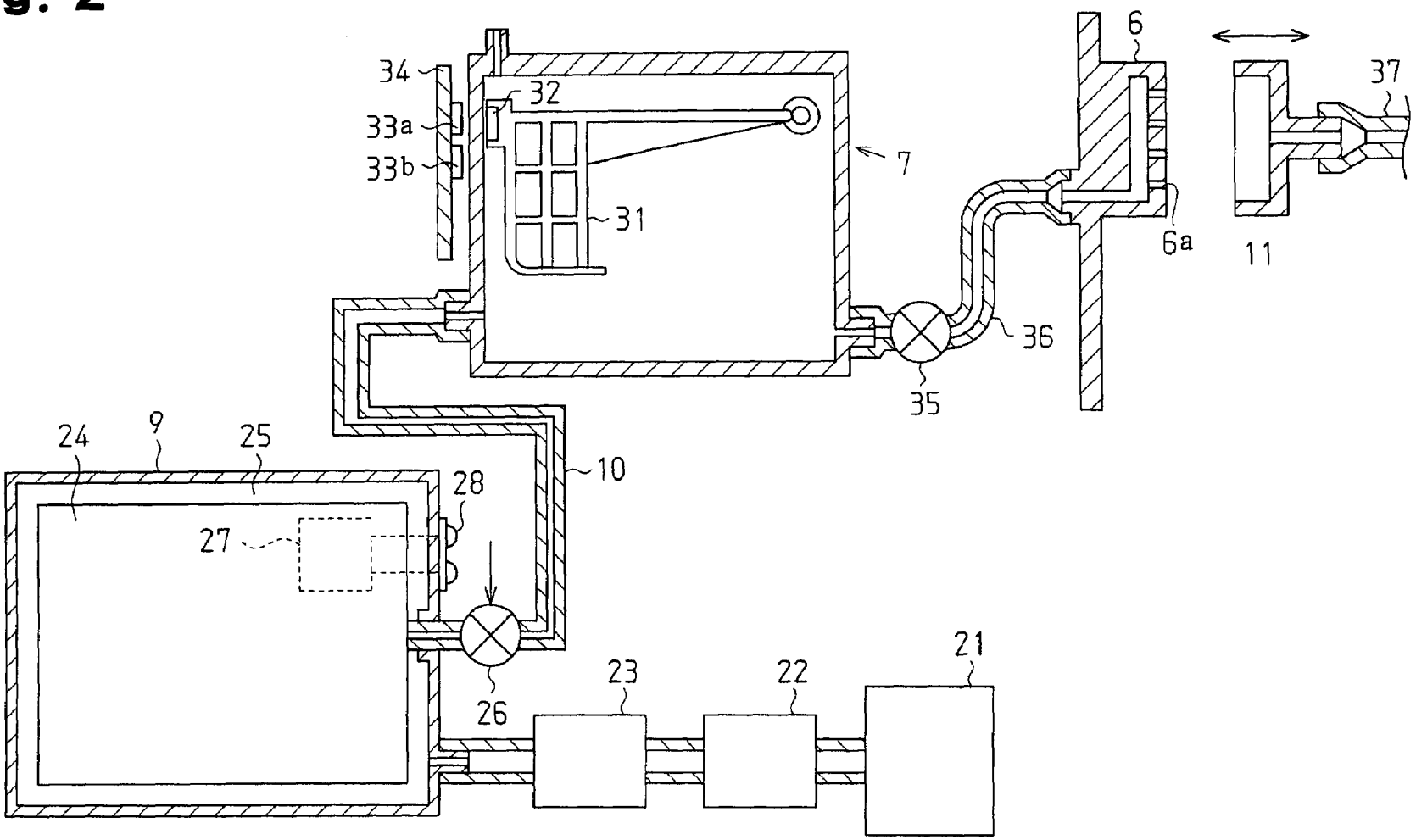
FIG. 2 is a schematic diagram showing the structure of a pressurized air supply system, an ink supply system, and a liquid waste system included in the recording apparatus.

FIG. 2 is a schematic diagram showing the structure of the ink supply system included in the recording apparatus. Referring to FIGS. 1 and 2, air that is pressurized by an air pressurization pump 21 (functioning as pressurized gas) is supplied to a pressure release valve 22. The pressurized air is supplied from the pressure release valve 22 to each of the main tanks 9*a* to 9*d* via a pressure detector 23.

In FIG. 2, the main tanks 9*a* to 9*d* are represented by reference numeral 9 and will hereafter be described as the main tank 9.

When the pressure of the air that is pressurized by the air pressurization pump 21 increases and becomes excessively high, the pressure release valve 22 releases the pressure into the atmosphere so that the air pressure applied to the main tanks 9*a* to 9*d* is maintained in a predetermined range. The air pressure adjustment is performed to avoid problems that may occur when the air pressurization pump 21 is continuously driven after, for example, a failure occurs in a pressurized air supply system including the pressure detector 23 and the air pressurization pump 21. If the air pressurization pump 21 is continuously driven after such a failure and the air pressure is not adjusted with the pressure release valve 22, excessively high air pressure may be applied to the main tank 9. This may cause a problem such as damage being inflicted on ink packs 24.

The pressure detector 23, which detects the pressure of the air pressurized by the air pressurization pump 21, functions to control the driving of the air pressurization pump 21. When a pressure detection value P obtained by the pressure detector 23 reaches a predetermined pressure P1, a pressurization pump motor 59 of the air pressurization pump 21 (refer to FIG. 9) is controlled by a CPU 101 so that it stops operating after a predetermined drive time T1 elapses.

Referring to FIG. 2, the main tank 9 has a hermetically sealed structure and accommodates the ink packs 24. Each ink pack 24 is formed from an elastic material and contains ink that is sealed therein. A pressurization chamber 25 is defined by a space formed by the main tank 9 and the corresponding ink pack 24. The pressurized air is supplied via the pressure detector 23 into the pressurization chamber 25. The pressure of the pressurized air is applied to each ink pack 24 of the main tanks 9*a* to 9*d* to generate a flow of ink from each of the main tanks 9*a* to 9*d* to the corresponding one of the sub tanks 7*a* to 7*d*.

The ink pressurized in each of the main tanks 9*a* to 9*d* is supplied to the corresponding one of the sub tanks 7*a* to 7*d* in the carriage 1 via an ink supply valve 26 arranged in the vicinity of the ink outlet of each ink pack 24 and the corresponding ink supply tube 10. The sub tanks 7*a* to 7*b* are represented by a reference numeral 7 in FIG. 2 and will hereafter be described as the sub tank 7.

As shown in FIG. 2, a float member 31 is arranged inside the sub tank 7. A permanent magnet 32 is fixed to the float member 31. Hall devices 33*a* and 33*b*, which function as magnetoelectric transformation devices, which are arranged on a substrate 34, are arranged along the side wall of the sub tank 7. The Hall devices 33*a* and 33*b* generate an electrical output in accordance with the amount of magnetic line of force generated by the permanent magnet 32 based on the floating position of the float member 31. The permanent magnet 32 and the Hall devices 33*a* and 33*b* form an ink amount detection unit.

When the ink amount in the sub tank 7 decreases, the float member 31 in the sub tank 7 moves downward due to gravity. This also moves the permanent magnet 32 downward. As a result, the electrical output of the Hall devices 33*a* and 33*b* that depends on the movement of the permanent magnet 32 is detected as the amount of ink in the sub tank 7. The ink supply valve 26 opens in response to the electrical output of the Hall devices 33*a* and 33*b*. As a result, the ink that is pressurized in the main tank 9 starts being supplied into the sub tank 7 of which ink amount has decreased.

When the ink amount of the sub tank 7 reaches a predetermined volume, the ink supply valve 26 is closed based on the electrical output of the Hall devices 33*a* and 33*b*. This sequence is repeated to intermittently supply ink from the main tank 9 to the sub tank 7. This structure enables a substantially fixed amount of ink to be constantly stored in each sub tank 7.

In this way, the ink pressurized by the air pressure in the main tank 9 is supplied to the sub tank 7 based on the electrical output that depends on the position of the float member 31 arranged in the sub tank 7. This structure improves the ink supply response and appropriately controls the amount of ink stored in the sub tank 7.

The ink is supplied from the sub tank 7 to the recording head 6 via a valve 35 and a tube 36 connected to the valve 35. Based on print data provided to an actuator (not shown) of the recording head 6, ink droplets are ejected from nozzle holes 6*a* that are formed on the nozzle surface of the recording head 6. The tube 36 forms the ink supply system together with the ink supply tubes 10.

As shown in FIG. 2, a tube 37 connected to the capping unit 11 is connected to a waste liquid tank (not shown) via the suction pump (not shown). Waste liquid of ink drawn by the suction pump is guided into the waste liquid tank.

Figure 3:
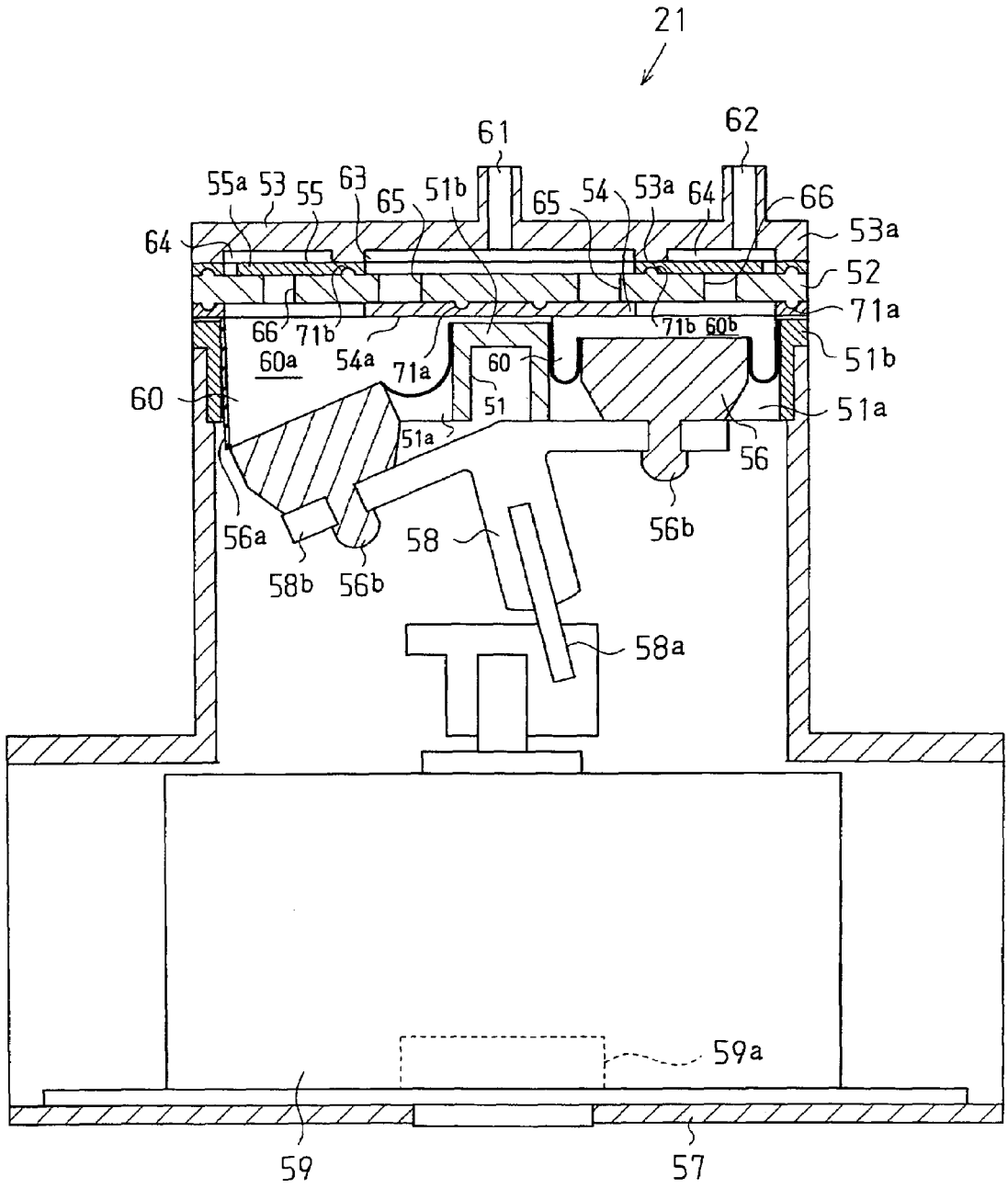
FIG. 3 is a schematic cross-sectional diagram of an air pressurization pump taken along line 3-3 in FIG. 4.

FIG. 3 is a cross-section diagram of the air pressurization pump 21, which is a diaphragm pump. The air pressurization pump 21 is not limited to a diaphragm pump. As shown in FIG. 3, a lower case 51 has three holes 51*a* and a flat fixed portion 51*b*. The three holes 51*a* are arranged at fixed intervals (angular intervals of 120 degrees) in the circumferential direction of the lower case 51. A diaphragm 56*a*, which defines pump chamber 60, is arranged in the holes 51*a*. A diaphragm main body 56 includes diaphragms 56*a* and fixed diaphragm portions 56*b*. The fixed diaphragm portions 56*b* are fixed to a drive unit 58 for moving the diaphragms 56*a* up and down. In the diaphragm pump shown in FIG. 3, the diaphragm main body 56 includes three diaphragms 56*a* and three fixed diaphragm portions 56*b*, which are formed integrally.

Figure 4:
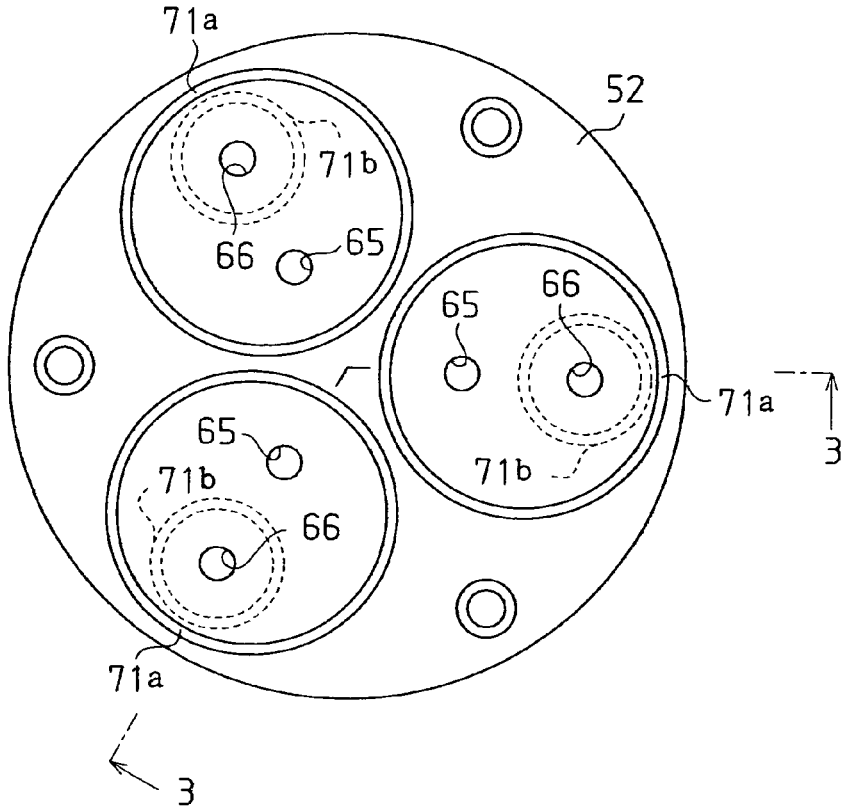
FIG. 4 is a bottom view showing an intermediate plate.

As shown in FIG. 4, a flat intermediate plate 52 has three suction holes 65 and three discharge holes 66 that communicate with three pump chambers 60, respectively. More specifically, one suction hole 65 and one discharge hole 66 form a pair, with each pair of the suction hole 65 and the discharge hole 66 corresponding to one of the pump chambers 60.

As shown in FIG. 4, three annular projections 71*a* are formed on the lower surface of the intermediate plate 52. Each annular projection 71*a* surrounds one pair of the suction hole 65 and the discharge hole 66. Further, three annular projections 71*b* are formed on the upper surface of the intermediate plate 52. Each annular projection 71*b* surrounds one discharge hole 66. FIG. 4 shows the lower surface of the intermediate plate 52.

A unidirectional suction valve 54 is fixed together with the diaphragm main body 56 between the lower case 51 and the intermediate plate 52. The unidirectional suction valve 54 is made of film of a flexible material. Portions on the upper surface of the unidirectional suction valve 54 corresponding to the lower case 51 are elastically deformed so as to be in contact with the projections 71*a*.

Figure 5A:
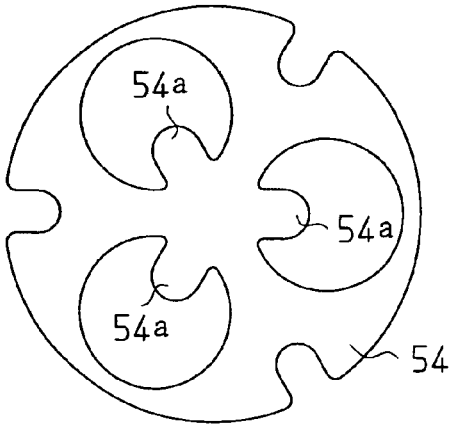
FIG. 5(*a*) is a plan view showing a unidirectional suction valve, and FIG. 5(*b*) is a plan view showing a unidirectional discharge valve.
Figure 5B:
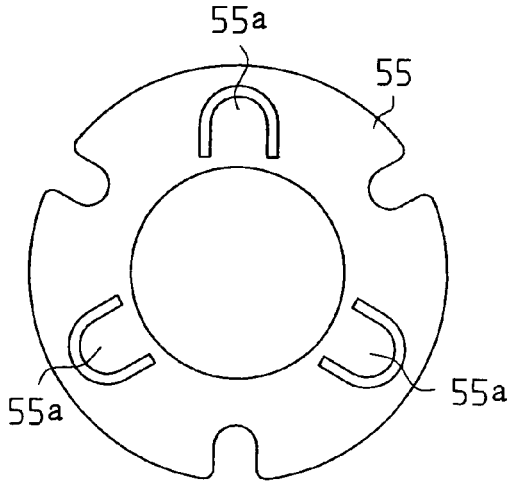

As shown in FIG. 5(*a*), valve members 54*a* are arranged at positions of the unidirectional suction valve 54 corresponding to the suction holes 65 of the intermediate plate 52. The surface of each valve member 54*a* that is in contact with the intermediate plate 52 has a surface roughness Ra of 0.1 to 10 μm and includes fine projections and depressions. This prevents the unidirectional valve 54, which is formed from a film of flexible material, and the intermediate plate 52, which includes the suction holes 65 that are in communication with the pump chambers 60, from sticking to each other. Further, operation of the unidirectional valve 54 is enabled even if the pressure difference between an upstream side and a downstream side of each unidirectional valve member 54*a* is small.

FIG. 5(*b*) shows the top surface of a unidirectional discharge valve 55 in the same manner as FIG. 5(*a*). The unidirectional discharge valve 55 is formed from a film of a flexible material.

The unidirectional discharge valve 55 is fixed between the intermediate plate 52 and an upper case 53. Portions of the upper surface of the unidirectional discharge valve 55 corresponding to the upper case 53 are elastically deformed so as to be in contact with the projections 71*b*.

As shown in FIG. 5(*b*), valve members 55*a* are arranged at positions of the unidirectional discharge valve 55 corresponding to the discharge holes 66 of the intermediate plate 52. In the same manner as that of each valve member 54*a*, the surface of each valve member 55*a* that is in contact with the intermediate plate 52 has a surface roughness Ra of 0.1 to 10 μm and includes fine projections and depressions. This prevents the unidirectional valve 55, which is formed from a film of flexible material, and the intermediate plate 52, which includes the discharge holes 66 that are in communication with the pump chambers 60, from sticking to each other. Further, operation of the unidirectional valve 55 is enabled even if the pressure difference between an upstream side and a downstream side of each unidirectional valve member 55*a* is small.

The unidirectional suction valve 54 is fixed between the lower case 51 and the intermediate plate 52 and the unidirectional discharge valve 55 is fixed between the upper case 53 and the intermediate plate 52. Thus, if the valves 54 and 55 are provided with a sealing function, there would be no need for a separate sealing member.

The upper case 53 includes a fixed portion 53*a* that comes in contact with the unidirectional discharge valve 55. The lower surface of the fixed portion 53*a* is flat. A suction passage 63 and a discharge passage 64 are defined between the intermediate plate 52 and the fixed portion 53*a*. The suction passage 63 communicates with each suction hole 65 and has a circular cross-section. The discharge passage 64 communicates with each discharge hole 66 and has an annular cross-section that is concentric with the suction passage 63. A suction port 61 that communicates with the suction passage 63 is formed in the middle portion of the upper surface of the upper case 53. A discharge port 62 that communicates with the discharge passage 64 is formed in the peripheral portion of the upper surface of the upper case 53.

The pump 21 has a bottom portion to which a cover 57 is attached. The cover 57 is fixed to the pressurization pump motor 59 by, for example, screws. The pressurization pump motor 59 includes a drive unit 58. The drive unit 58 includes a pin 58*a* and an umbrella-shaped vertical movement driver 58*b*. The pin 58*a*, which is inclined relative to a rotation shaft of the pressurization pump motor 59, is inserted in the vertical movement driver 58*b*. The fixed diaphragm portions 56*b* of the diaphragm main body 56 are inserted in the vertical movement driver 58*b*. The pressurization pump motor 59 is formed by a step motor. The pressurization pump motor 59 includes a rotary encoder 59*a*, which is fixed to the rotation shaft to detect the rotation angle of the rotation axis.

Although not shown in FIG. 3, the lower case 51, the intermediate plate 52, the unidirectional suction valve 54, the unidirectional discharge valve 55, and the diaphragm main body 56 of the diaphragm pump are fixed together by fixing the upper case 53 and the cover 57 with, for example, screws. FIG. 3 shows a pump chamber 60*a* of which diaphragm 56*a* is lowered and a pump chamber 60*b* of which diaphragm 56*a* is raised.

The operation of the air pressurization pump 21 will now be described.

First, rotation generated by the pressurization pump motor 59 is converted into an upward and downward movement by the drive unit 58, which includes the pin 58*a* and the vertical movement driver 58*b*. The pin 58*a* is fixed to the pressurization pump motor 59 and rotated by the rotation generated by the motor 59. The pin 58*a* is inserted into the vertical movement driver 58*b* in a relatively rotatable manner. The fixed diaphragm portions 56*b* are inserted in the vertical movement driver 58*b*. The rotation of the pressurization pump motor 59 is converted into the upward and downward movement of the diaphragm 56*a* by the vertical movement driver 58*b*.

When the diaphragm 56*a* of the diaphragm main body 56 is lowered, the valve member 54*a* of the unidirectional suction valve 54 is elastically deformed to open the valve 54. Then, fluid (air in the present embodiment) flows through the suction port 61 and the suction hole 65 of the intermediate plate 52 to enter the pump chamber 60. As the rotation of the pressurization pump motor 59 completely lowers the diaphragm 56*a* in the pump chamber 60*a*, as shown in the state of FIG. 3, the unidirectional suction valve member 54*a* is closed by its own elasticity and the diaphragm 56*a* starts rising. When the diaphragm 56*a* starts rising, the valve member 55*a* of the unidirectional discharge valve 55 is deformed to open the valve 55. As a result, liquid flows through the discharge hole 66 of the intermediate plate 52 and out from the discharge hole 66. The pumping function of the air pressurization pump 21 is realized through this process. The liquid that flows from the discharge port 62 is sent to the pressure release valve 22 shown in FIG. 2.

Figure 6:
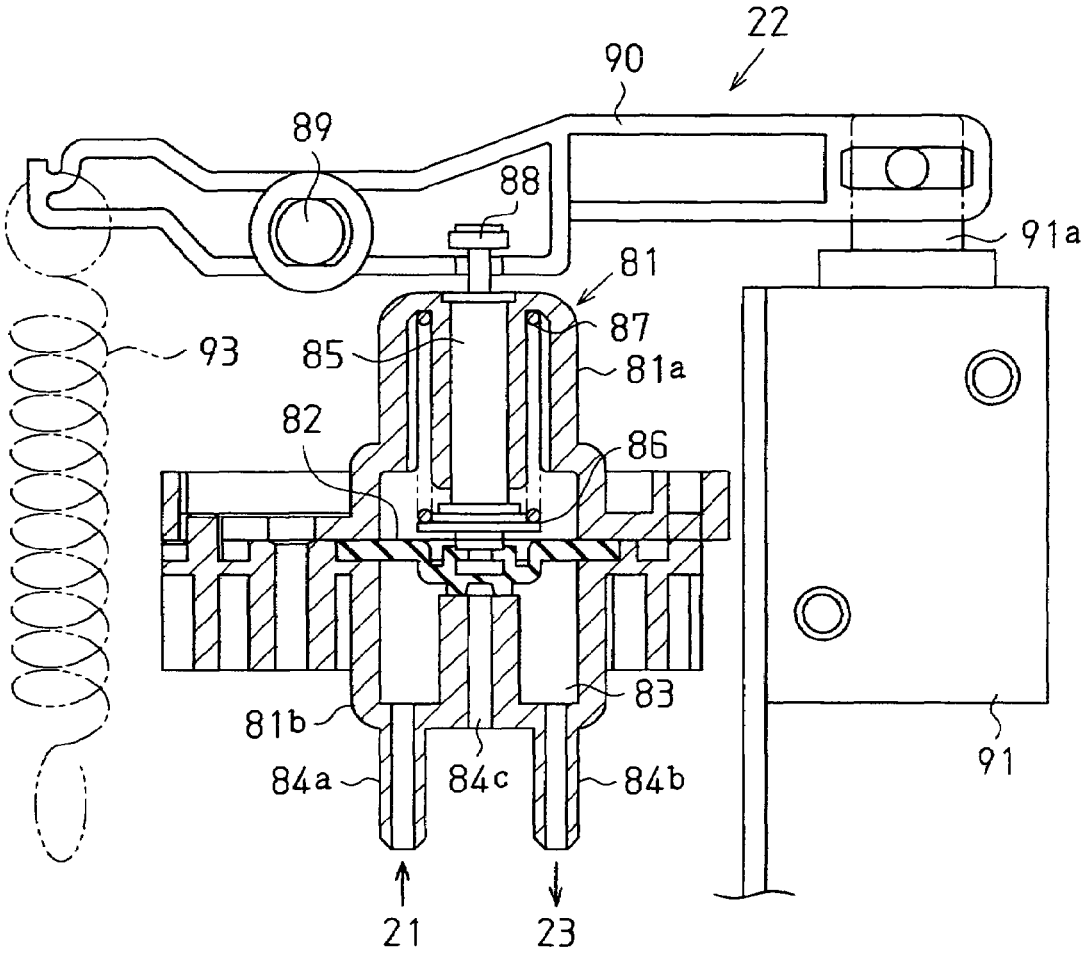
FIG. 6 is a schematic cross-sectional diagram of a pressure release valve.
Figure 7:
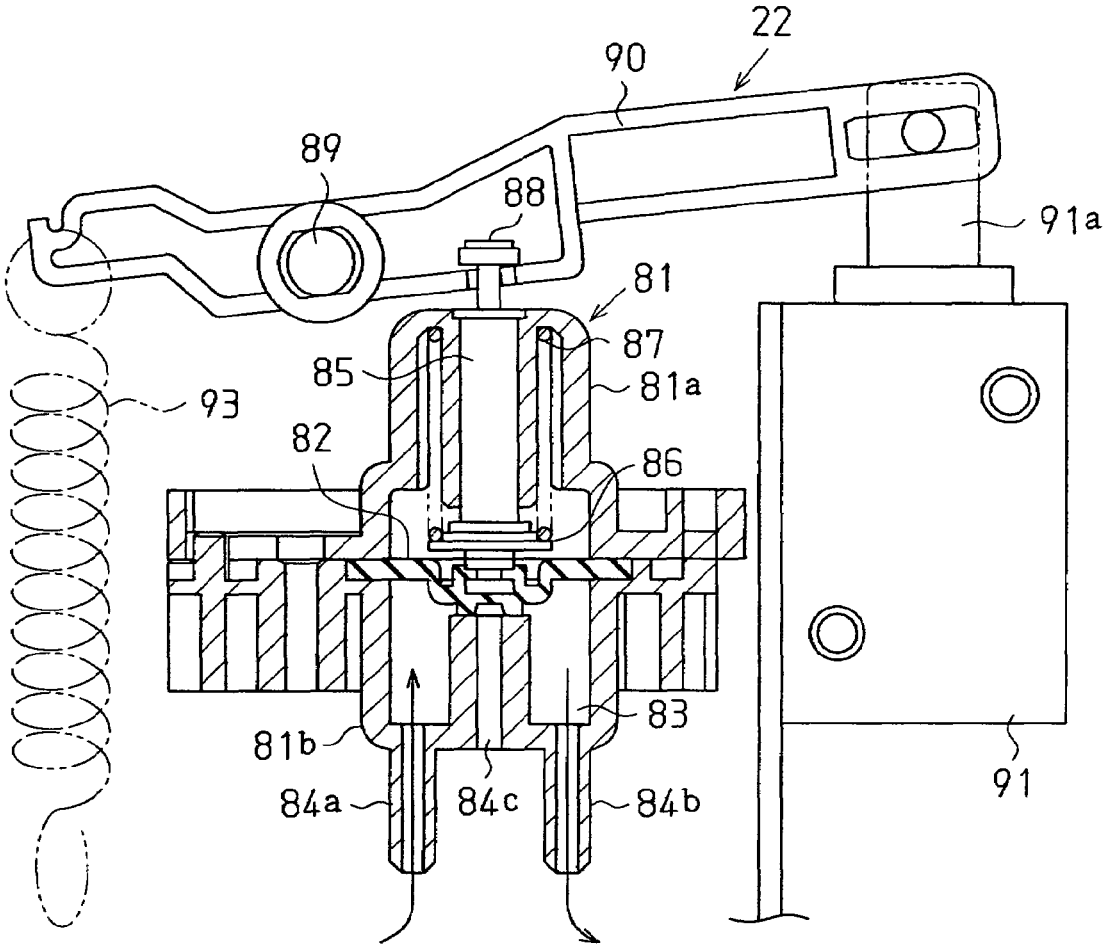
FIG. 7 is a schematic cross-sectional diagram of the pressure release valve.

FIGS. 6 and 7 show the structure of the pressure release valve 22, which also serves as a regulator. The pressure release valve 22 functions as a pressure releasing unit.

As shown in FIGS. 6 and 7, a valve unit 81 has an upper case 81*a* and a lower case 81*b*. The upper case 81*a* and the lower case 81*b* each have an inner space. The valve unit 81 is divided into upper and lower parts by the upper case 81*a* and the lower case 81*b*. A diaphragm valve 82 is arranged at a portion where the upper case 81*a* and the lower case 81*b* are connected to each other. The diaphragm valve 82 is formed by a circular rubber plate. The peripheral portion of the diaphragm valve 82 is held between the portions where the upper case 81*a* and the lower case 81*b* are connected to each other. The inner space of the lower case 81*b* defines a sealed air chamber 83.

Two connection pipes 84*a* and 84*b* are formed in the lower case 81*b* in communication with the air chamber 83. The connection pipes 84*a* and 84*b* are connected to an air passage extending from the air pressurization pump 21 to the main tank, which functions as the ink cartridge, via the pressure detector 23. The pressurized air from the air pressurization pump 21 is supplied to the pressure detector 23 and each main tank 9 via the air chamber 83 as indicated by the arrow shown in FIG. 7. Further, an atmospheric passage 84*c* is formed in the middle of the lower case 81*b*. The atmospheric passage 84*c* is formed so that a substantially middle part of the diaphragm valve 82 comes in contact with an open end of the atmospheric passage 84*c* that is connected to the air chamber 83.

A drive shaft 85 is arranged in the upper case 81*a* in a manner that the drive shaft 85 is movable in the upward and downward directions. The middle of the diaphragm valve 82 is supported by the lower end of the drive shaft 85. An annular spring seat 86 is fixed to the drive shaft 85. A coil spring member (compression spring) 87 is arranged between the spring seat 86 and the inner upper part of the upper case 81*a*. The spring member 87 presses the middle part of the diaphragm valve 82 so that the middle part of the diaphragm valve 82 comes in contact with the open end of the atmospheric passage 84*c*.

An engagement head 88 is arranged on the top end of the drive shaft 85. A drive lever 90 is supported on the cartridge holder 8 by a support shaft 89. The engagement head 88 is engaged with the drive lever 90 between the right end of the drive lever 90 and the support shaft 89. An operation rod 91*a* of a solenoid 91 is connected to the right end of the drive lever 90. Further, a spring member, or a tension spring 93, is fixed to the left end of the drive lever 90 leftward from the support shaft 89. The tension spring 93 functions to urge the drive lever 90 about the support shaft 89 in the counterclockwise direction.

With this structure, the right end of the drive lever 90 is pulled down against the urging force applied by the tension spring 93 when the solenoid 91 is energized, as shown in the state of FIG. 6. In this state, the engagement head 88, which is fixed to the drive shaft 85 of the valve unit 81, is spaced in the upward direction from the drive lever 90. This closes the diaphragm valve 82. In this state, the atmospheric passage 84*c* is closed by the urging force applied by the spring member 87 and the elastic force of the diaphragm valve 82.

When the diaphragm valve 82 is closed, if the air pressurization pump 21 is driven and the pressure in the air chamber 83 exceeds a relief pressure P3 (refer to FIG. 13), that is, when the pressure in the air chamber 83 exceeds a valve closing pressure, which is based on the urging force of the spring member 87 and the elastic force of the diaphragm valve 82, the diaphragm valve 82 is moved upward by the air pressure. As a result, the diaphragm valve 82 is released from the atmospheric passage 84*c*. Accordingly, the pressurized air flows from the air chamber 83 via the atmospheric passage 84*c* to be released into the atmosphere.

In this manner, when the pressure of the pressurized air in the air chamber 83 decreases to a predetermined value, the valve closing pressure, which is based on the urging force of the spring member 87 and the elastic force of the diaphragm valve 82, closes the atmospheric passage 84*c* again. As a result, the pressure of the air passage from the air pressurization pump 21 to the main tank 9 is controlled to be in a predetermined range. Accordingly, when the air pressure exceeds a predetermined pressure in the energized state of the solenoid 91 shown in FIG. 6, the diaphragm valve 82 functions as a pressure regulating valve by repeating such opening and closing operations. When, for example, a failure occurs in the control of the pressurized air, the pressure regulating valve function prevents the air pressure from becoming abnormally high. This avoids problems such as damage being inflicted on the ink packs 24.

When the solenoid 91 is de-energized as shown in the state of FIG. 7, the tension spring 93 pivots the drive lever 90 in a counterclockwise direction. The urging force of the tension spring 93 lifts the drive shaft 85 of the valve unit 81 against the urging force of the spring member 87 and the elastic force of the diaphragm valve 82. When the diaphragm valve 82 is spaced from the atmospheric passage 84*c*, the pressurized air in the air chamber 83 is forcibly released via the atmospheric passage 84*c*.

Figure 8:
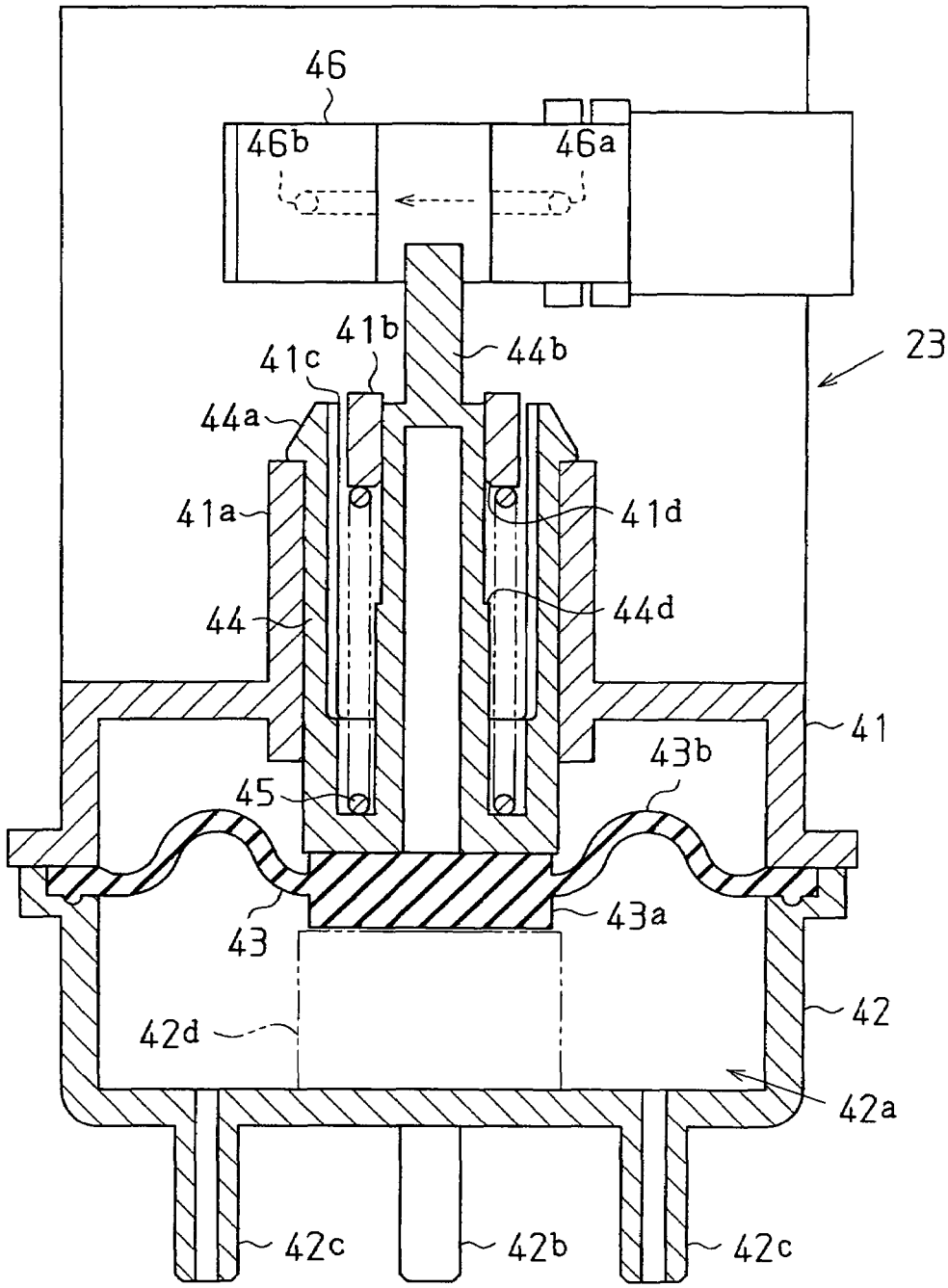
FIG. 8 is a schematic cross-sectional diagram of a pressure detector.

FIG. 8 is a cross-sectional diagram showing the structure of the pressure detector 23. The pressure detector 23 includes an upper case 41 and a lower case 42. The upper case 41 and the lower case 42 are both cylindrical. A diaphragm 43 is arranged between the upper case 41 and the lower case 42 with its peripheral portion being held between the upper case 41 and the lower case 42. The diaphragm 43 is disk-shaped and is formed from a flexible and elastic material. The pressure detector 23 functions as a pressure detection unit.

As shown in FIG. 8, the diaphragm 43 has a middle portion defining a thick portion 43*a*. A thin portion 43*b* is defined between the thick portion 43*a* and the peripheral portion of the diaphragm 43. The thin portion 43*b* has a semi-circular cross-section. The diaphragm 43 is preferably formed from a rubber material. The diaphragm 43 may be formed by filling a cloth with a rubber material. This would increase the durability of the diaphragm 43.

A cylindrical body 41*a* is formed integrally with the upper portion of the upper case 41. Further, an inner cylindrical body 41*b* is formed in the upper portion of the cylindrical body 41*a*. Although the inner cylindrical body 41*b* is shown in a state separated from the cylindrical body 41*b* in the cross-sectional diagram of FIG. 8, the inner cylindrical body 41*b* is connected with the cylindrical body 41*a* at a position separated from the position shown in the drawing by an angular distance of 90 degrees. Thus, as shown in the cross-sectional diagram of FIG. 8, two openings 41*c*, which are opposed to each other, are defined between the cylindrical body 41*a* and the inner cylindrical body 41*b*.

A movable member 44 is accommodated in the cylindrical body 41*a* in a manner that the member 44 is movable in the upward and downward directions as viewed in FIG. 8. The movable member 44 has a bifurcated structure. A hook-shaped stopper 44*a* is formed at each upper end of the bifurcated movable member 44. The stopper 44*a* is arranged in the opening 41*c* and engaged with the upper end of the cylindrical body 41*a*.

The movable member 44 includes a spring rod 44*b*, which is formed integrally with the inner bottom portion of the movable member 44. In the present embodiment shown in FIG. 8, a coil spring member 45 is wound around the spring rod 44*b* between the lower end of the inner cylinder body 41*b* and the inner bottom of the movable member 44. With this structure, the movable member 44 is pressed by the spring member 45 in the downward direction as viewed in the drawing. As a result, the bottom of the movable member 44 comes in contact with the upper surface of the middle thick portion 43*a* of the diaphragm 43.

A connection pipe 42*b* and a plurality of connection pipes 42*c* are formed in the lower case 42. The connection pipe 42*b* introduces the pressurized air from the air pressurization pump 21 into a space 42*a* defined between the lower case 42 and the diaphragm 43. Each connection pipe 42*c* distributes the pressurized air from the space 42*a* to the corresponding main tank 9. The recording apparatus of the present embodiment includes the four main tanks 9 as described above and four pressurized air distribution connection pipes 42*c* corresponding to the four main tanks 9. FIG. 8 shows only two of the four connection pipes 42*c*.

With this structure, the pressurized air is introduced from the air pressurization pump 21 into the space 42*a* of the pressure detector 23 via the pressurized air introduction connection pipe 42*b* and then sent to the pressurization chamber 25 in each main tank 9 via the corresponding pressurized air distribution connection pipe 42*c*. The pressurized air introduced into the space 42*a* causes the diaphragm 43 to move upward as viewed in FIG. 8. This upwardly moves the movable member 44. The space formed between the diaphragm 43 and the case 41 is in communication with the atmosphere via a gap formed between the cylindrical body 41*a* and the movable member 44.

In the present embodiment, the spring member 45 urges the movable member 44 downward as viewed in FIG. 8. With this structure, the movable member 44 is moved in the upward and downward directions based on the position of the diaphragm 43 that is changed by the balance of the air pressure applied to the diaphragm 43, the resilient force generated by the elasticity of the diaphragm 43, and the urging force generated by the spring member 45.

The movable member 44 includes a stepped portion 44*d* for preventing the position of the diaphragm 43 from changing excessively when the pressurized air is applied to the diaphragm 43. More specifically, when the air pressure applied to the diaphragm 43 is normal or less than normal and then shifts to a state in which the air pressure becomes greater than a predetermined level, the movable member 44 moves upward. This moves the movable member 44 upward until the stepped portion 44*d* of the spring rod 44*b* comes in contact with a contact portion 41*d* defined on the lower end of the inner cylindrical body 41*b*. As a result, further upward movement of the movable member 44 is restricted. This structure prevents the diaphragm 43 from being moved excessively and enables the pressure detector 23 to function normally.

In the present embodiment shown in FIG. 8, the movable member 44 is bifurcated, and the hook-shaped stoppers 44*a* are formed on the upper ends of the bifurcated movable member 44. The stoppers 44*a* are engaged with the upper end of the cylindrical body 41*a* and prevent the diaphragm 43 from being moved excessively by the spring member 45. When the hook-shaped stoppers 44*a* are not formed, it is preferable that a cylindrical stopper 42*d* for preventing the diaphragm from being moved excessively be formed in the middle of the bottom of the lower case 42 as indicated by the broken lines in FIG. 8. In this case, the cylindrical stopper 42*d* is formed integrally with the lower case 42.

A detection unit 46 lies along a vertical movement passage of the top end of the spring rod 44*b* of the movable member 44. In the present embodiment, the detection unit 46 is formed by a photosensor, which includes a light source 46*a* and a light receiving element 46*b* that are arranged to face each other. When the pressurized air introduced into the space 42*a* does not reach the predetermined pressure P1 (less than the predetermined pressure), light projected from the light source 46*a* reaches the light receiving element 46*b*. As a result, the light receiving element 46*b* generates an electric output (off-signal). When the pressurized air reaches the predetermined pressure P1 (becomes greater than or equal to the predetermined pressure), the diaphragm 43 moves, and the top end of the spring rod 44*b* of the movable member 44 enters the space between the light source 46*a* and the light receiving element 46*b* of the detection unit 46, so as to block the optical axis that extends from the light source 46*a* to the light receiving element 46*b*. When the optical axis extending from the light source 46*a* to the light receiving element 46*b* is blocked, the detection unit 46 outputs an on-signal. The predetermined pressure P1 is determined so that it is equal to the lowest value at which ink droplets (liquid droplets) are ejected from the nozzles of the recording head 6 to enable printing, cleaning, or flushing (preparatory ejecting).

The detection unit 46 is not limited to a photosensor and may be any device that detects whether the pressurized air reaches the predetermined pressure P1.

A control circuit for the inkjet recording apparatus will now be described with reference to FIG. 9.

Figure 9:
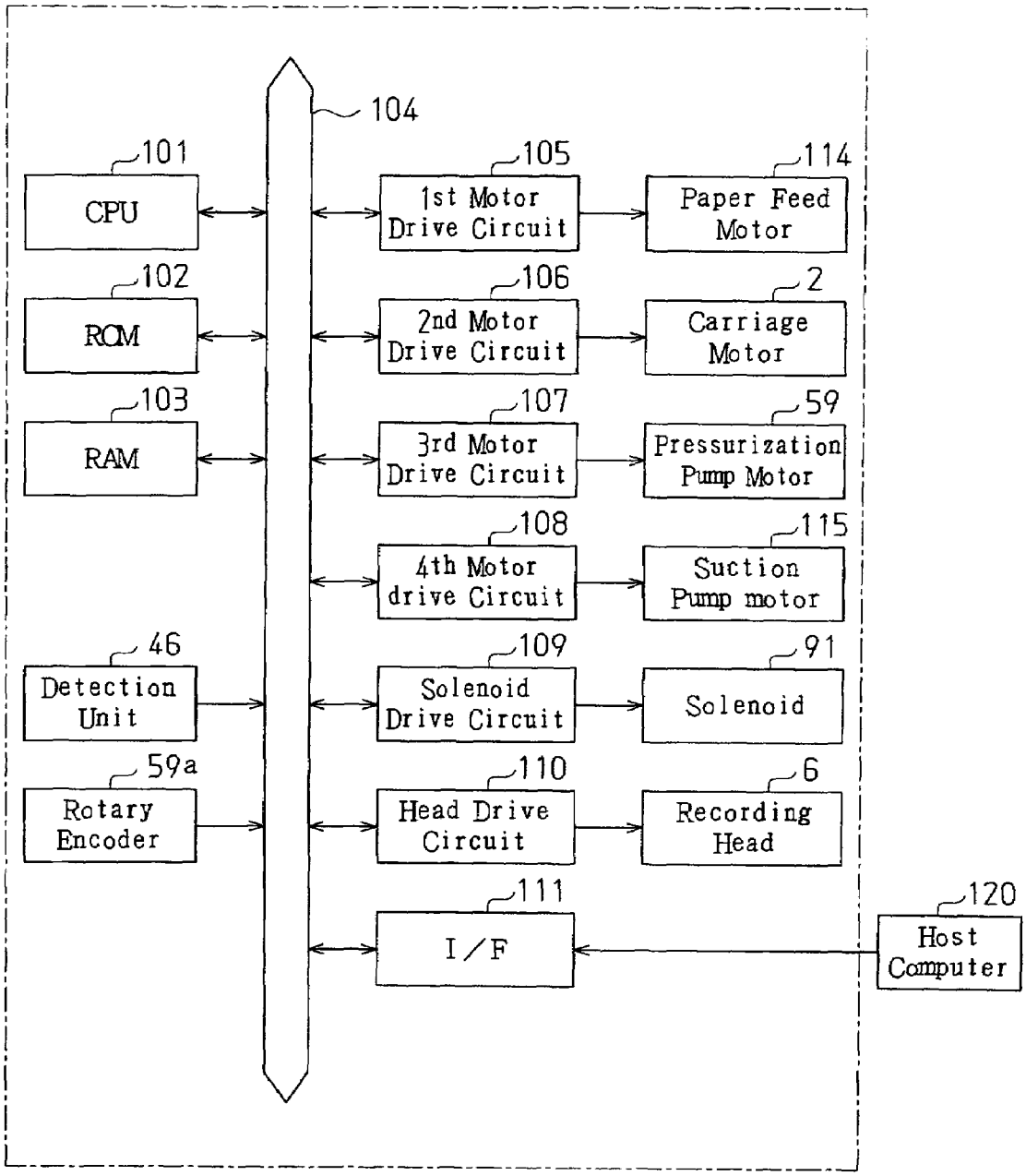
FIG. 9 is a block diagram showing the electric structure of the inkjet recording apparatus.

As shown in FIG. 9, the inkjet recording apparatus includes a CPU 101 functioning as a control unit, a ROM 102, and a RAM 103. The inkjet recording apparatus further includes the detection unit 46, a first motor drive circuit 105, a second motor drive circuit 106, a third motor drive circuit 107, a fourth motor drive circuit 108, a solenoid drive circuit 109, a head drive circuit 110, an interface (I/F) 111, and the rotary encoder 59*a*. These devices are connected to one another by a bus 104.

The CPU 101 controls the detection unit 46 to output an on-signal when the pressurized air detected by the pressure detector 23 reaches the predetermined pressure P1 and to output an off-signal when the pressurized air detected by the pressure detector 23 is less than the predetermined pressure P1. Further, the CPU 101 is connected via the first motor drive circuit 105 to a paper feed motor 114, for driving and rotating the paper feeder 5, and outputs a control signal for driving of the motor 114.

The CPU 101, which is connected via the second motor drive circuit 106 to the carriage motor 2, outputs a control signal for driving of the carriage motor 2.

The CPU 101 is connected via the third motor drive circuit 107 to the pressurization pump motor 59 and outputs a drive control signal for generating rotation with the pressurization pump motor 59. The CPU 101 outputs a drive control signal via the fourth motor drive circuit 108 for generating rotation with a suction pump motor 115 for driving the suction pump (not shown). The CPU 101 is connected via the solenoid drive circuit 109 to the solenoid 91 and outputs a drive control signal for energizing and de-energizing the solenoid 91. The CPU 101 is connected via the head drive circuit 110 to the recording head 6 and outputs a nozzle drive signal for driving a nozzle drive unit (not shown) for ejecting ink from the nozzles of the recording head 6.

The ROM 102 stores various programs for controlling the driving of the inkjet recording apparatus. The CPU 101 controls the driving of the paper feed motor 114, the carriage motor 2, the pressurization pump motor 59, the suction pump motor 115, the solenoid 91, and the recording head 6 in accordance with the programs. Further, the CPU 101 temporarily stores the operational results and other data obtained during the driving control in the RAM 103.

The CPU 101 further includes a pressurization pump counter. The pressurization pump counter counts the number of steps the pressurization pump motor 59 is rotated to determine the life of the air pressurization pump 21 driven by the pressurization pump motor 59.

The CPU 101 cumulates the number of steps (drive step number ST) the pressurization pump motor 59 is rotated whenever rotation is generated by the pressurization pump motor 59. More specifically, the CPU 101 cumulates the drive step number ST during periods from when the driving of the pressurization pump motor 59 starts to when the driving of the pressurization pump motor 59 stops based on detection signals provided from the rotary encoder 59*a*. The CPU 101 then divides the cumulated drive step number ST by a conversion coefficient a to obtain a count value kp ($ST/\alpha$). Hereafter, the obtaining of the count value kp by cumulating the drive step number ST and dividing the cumulated value by the conversion coefficient $\alpha$ will simply be referred to as obtaining the count value kp.

The count value kp is divided by the rotation speed of the pressurization pump motor 59 (e.g., the average rotation speed) to obtain the actual continuous pressurization time of the air pressurization pump 21. The continuous pressurization time is hereafter referred to as the count value kp.

The CPU 101 adds the count value kp to the previously cumulated count value KP (previous value) of the pressurization pump counter, and sets the resulting value as the count value KP (present value) (KP (previous value)+kp). The count value KP (present value) is divided by the rotation speed of the pressurization pump motor 59 (e.g., the average rotation speed). This obtains the cumulated time of use of the air pressurization pump 21 up until the present.

The various programs include a print program, a cleaning program, a flushing program, a program for shifting to a power saving control mode and an ink cartridge pressurization program A and an ink cartridge pressurization program B executed in parallel with the print program, the cleaning program, and the flushing program. The modes of the inkjet recording apparatus in which the print program, the cleaning program, and the flushing program are executed are referred to as a print mode, a cleaning mode, and a flushing mode, respectively. The print mode, the cleaning mode, and the flushing mode correspond to a drive control mode.

The CPU 101 is communicably connected to a host computer 120 via the I/F 111. This enables the CPU 101 to receive an input of a print command from the host computer 120.

The operation of the inkjet recording apparatus will now be described.

Figure 10:
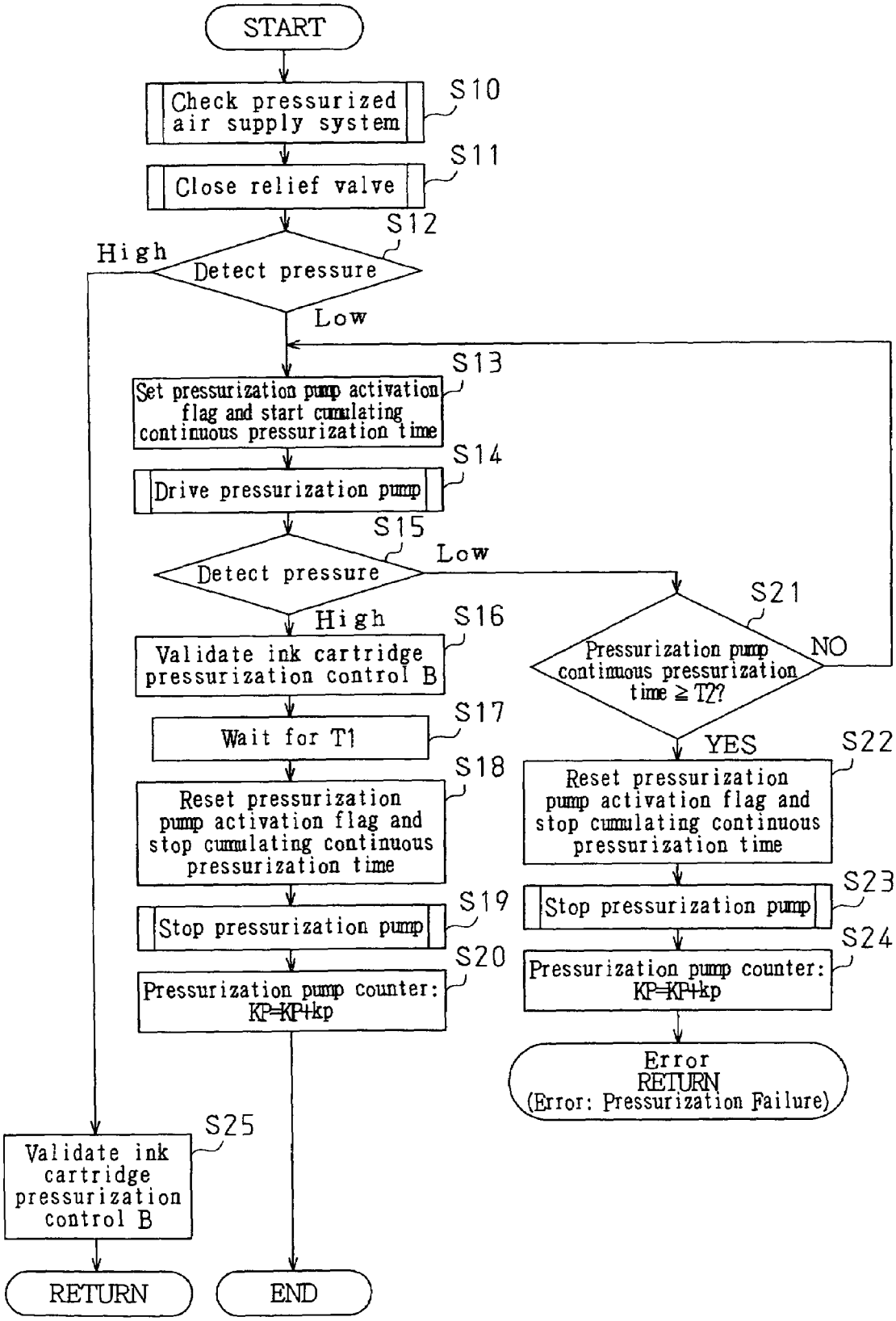
FIG. 10 is a flowchart showing a process executed by a CPU.

FIG. 10 is a flowchart showing the ink cartridge pressurization program A that is regularly executed by the CPU 101 in parallel with the print program, the cleaning program, or the flushing program. This program may be executed at time intervals of, for example, ten seconds or so. However, the present invention is not limited to such an execution frequency.

The flushing (preparatory ejection) program is executed to perform head cleaning by ejecting ink droplets from the nozzles of the recording head that is either covered by a cap member or located at a position where the ejected ink droplets (liquid droplets) do not reach a recording sheet (medium). The cleaning program differs from the flushing program in that the cleansing program is executed to perform head cleaning by drawing ink out of the nozzles of the recording head 6 covered by the cap member 11*a* with the suction pump (not shown).

In step S10, the CPU 101 checks the pressurized air supply system. The pressurized air supply system is a system for supplying the pressurized air to the air passage from the air pressurization pump 21 to the main tank 9. In the present embodiment, the pressurized air supply system refers to the air pressurization pump 21. Further, checking of the pressurized air supply system refers to checking of the life of the system.

Figure 12:
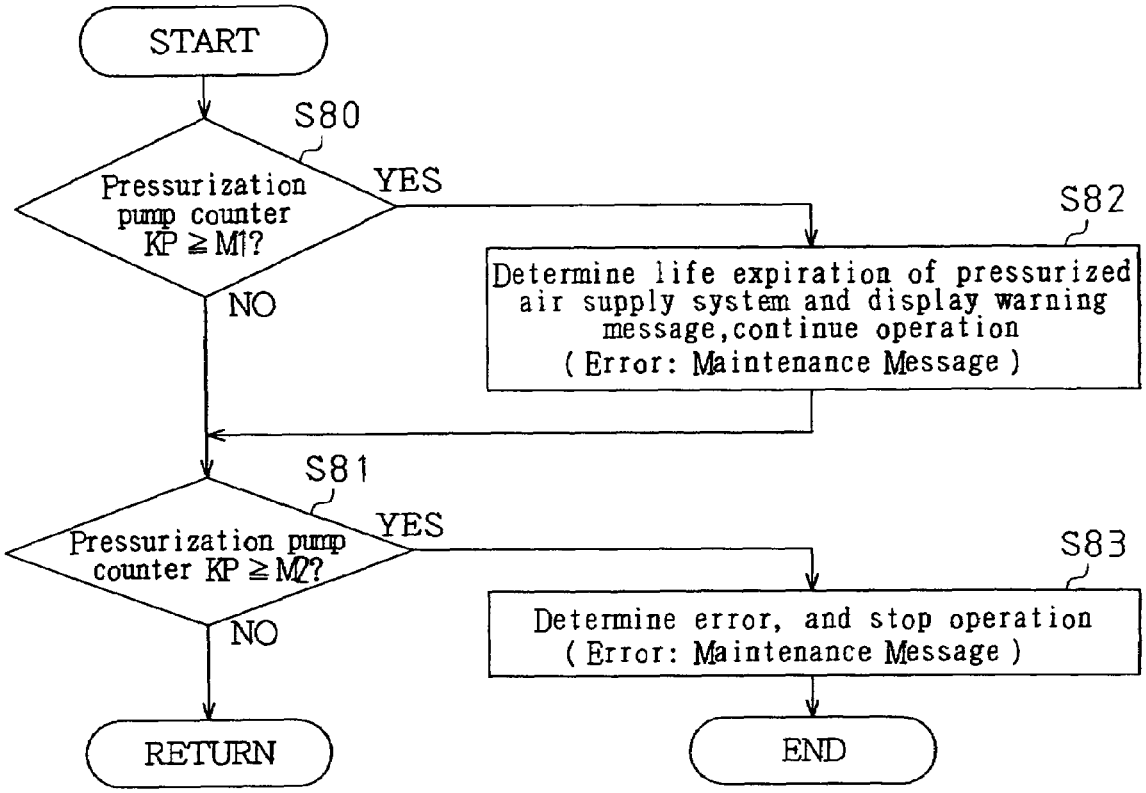
FIG. 12 is a flowchart showing a process executed by the CPU.

FIG. 12 is a flowchart showing a routine for checking the pressurized air supply system. In step S80, the CPU 101 determines whether the count value KP (present value) of the pressurization pump counter for counting the drive step number of the air pressurization pump 21 is greater than or equal to a first threshold M1. The first threshold M1 is a value obtained in advance through experiments and is smaller than a second threshold M2, which will be described later. The first threshold M1 is a value corresponding to the life of the air pressurization pump 21. The first threshold M1 is preferably about ½ to 7/10 of the second threshold M2 but is not limited to such a value. The first threshold M1 is used to determine whether the air pressuring pump 21 requires maintenance due to expiration of the life of the air pressurization pump 21.

In step S80, if the CPU 101 determines that the count value KP (present value) is greater than or equal to the first threshold M1, the life of the air pressurization pump 21 is assumed to have expired. Thus, the CPU 101 proceeds to step S82 and displays a warning message indicating the life expiry of the pressurized air supply system on a display (not shown) of the inkjet recording apparatus. The CPU 101 also communicates with the host computer 120 via the I/F 111 to display a warning message on a display connected to the host computer 120, such as a liquid crystal display.

When determining that the count value KP (present value) is smaller than the first threshold M1 in step S80, the CPU 101 proceeds to step S81.

When proceeding to step S81 from step S80 or step S82, the CPU 101 determines whether the count value KP (present value) of the pressurization pump counter is greater than or equal to the second threshold M2. The second threshold M2 is a value obtained in advance through experiments and is greater than the first threshold M1. When the CPU 101 determines that the count value KP is greater than or equal to the second threshold M2 in step S81, the CPU 101 proceeds to step S83. In step S83, the CPU 101 determines that an error has occurred and stops the pressurization pump motor 59. The CPU 101 also stops the parallel execution of the print program, the cleaning program, or the flushing program. Then, the CPU 101 terminates the routine.

When the CPU 101 determines that the count value KP is smaller than the second threshold value M2 in step S81, the CPU 101 terminates the routine.

Referring back to the flowchart of FIG. 10, in step S11, the CPU 101 outputs a drive control signal via the solenoid drive circuit 109 so that the solenoid 91 is energized to close the diaphragm valve 82, which functions as the relief valve.

In step S12, the CPU 101 determines whether the pressure detection value P of the detection unit 46 of the pressure detector 23 is greater than or equal to the predetermined pressure P1 (high) or smaller than the predetermined pressure P1 (low). When the CPU 101 determines that the pressure detection value P is greater than or equal to the predetermined pressure P1 (high) in step S12, the CPU 101 proceeds to step S25. In step S25, the CPU 101 sets a control validating flag for validating the ink cartridge pressurization control B. The CPU 101 then terminates the routine. When determining that the pressure detection value P is smaller than the predetermined pressure P2 (low) in step S12, the CPU 101 proceeds to step S13.

In step S13, the CPU 101 sets a pressurization pump activation flag indicating that the pressurization pump is in an activated state. Further, the CPU 101 starts cumulating the continuous pressurization time (i.e., the count value kp) when entering step S13 from step S12. The CPU 101 cumulates the continuous pressurization time (i.e., the count value kp) without resetting this value when entering step S13 from step S21. In step S14, the CPU 101 drives the pressurization pump motor 59.

In step S15, the CPU 101 determines whether the pressure detection value P of the detection unit 46 of the pressure detector 23 is greater than or equal to the predetermined pressure P1 (high) or smaller than the predetermined pressure P1 (low). When the CPU 101 determines that the pressure detection value P is greater than or equal to the predetermined pressure P1 in step S15, the processing proceeds to step S16. In step S16, the CPU 101 sets the control validating flag for validating the ink cartridge pressurization control B. When the CPU 101 determines that the pressure detection value P is smaller than the predetermined pressure P1 (low) in step S15, the CPU 101 proceeds to step S21.

In step S21, the CPU 101 determines whether the continuous pressurization time (i.e., the count value kp) of the air pressurization pump 21 is greater than or equal to a pressurization time abnormality determination value T2. The pressurization time abnormality determination value T2 is used to determine whether a pressurization failure is occurring in the air pressurization pump 21, which functions as the pressurized air supply system, or in the air passage supplied with pressurized air by the air pressurization pump 21. The pressurization time abnormality determination value T2 is set at a value of the continuous pressurization time that would not be reached when the air pressurization pump 21 or the air passage is normal but would be reached when a pressurization failure is occurring in the air pressurization pump 21 or the air passage.

When the CPU 101 determines that the continuous pressurization time (i.e., the count value kp) of the air pressurization pump 21 is smaller than the abnormality determination value T2 in step S21, the CPU 101 returns to step S13.

When the CPU 101 determines that the pressure detection value P is greater than or equal to the predetermined pressure P1 (high) in step S15, the CPU 101 sets the control validation flag for validating the ink cartridge pressurization control B in the same manner as in step S25. The CPU 101 then proceeds to step S17.

In step S17, the CPU 101 waits until the predetermined drive time T1 elapses after the pressure detection value P reaches the predetermined pressure P1. When the predetermined drive time T1 elapses, the CPU 101 proceeds to step S18 to reset the pressurization pump activation flag and stop cumulating the continuous pressurization time (i.e., the count value kp). In step S19, the CPU 101 stops the air pressurization pump 21. In step S20, the CPU 101 obtains the count value KP (present value) of the pressurization pump counter. More specifically, the CPU 101 adds the count value kp to the count value KP (previous value) of the pressurization pump counter to obtain the count value KP (present value).

With such processing executed by the CPU 101, the air pressure exceeding the predetermined pressure P1 detected by the pressure detector 23 is accumulated in the air passage, which extends from the air pressurization pump 21 to each main tank 9. After completing step S20, the CPU 101 terminates the routine.

Figure 13A:
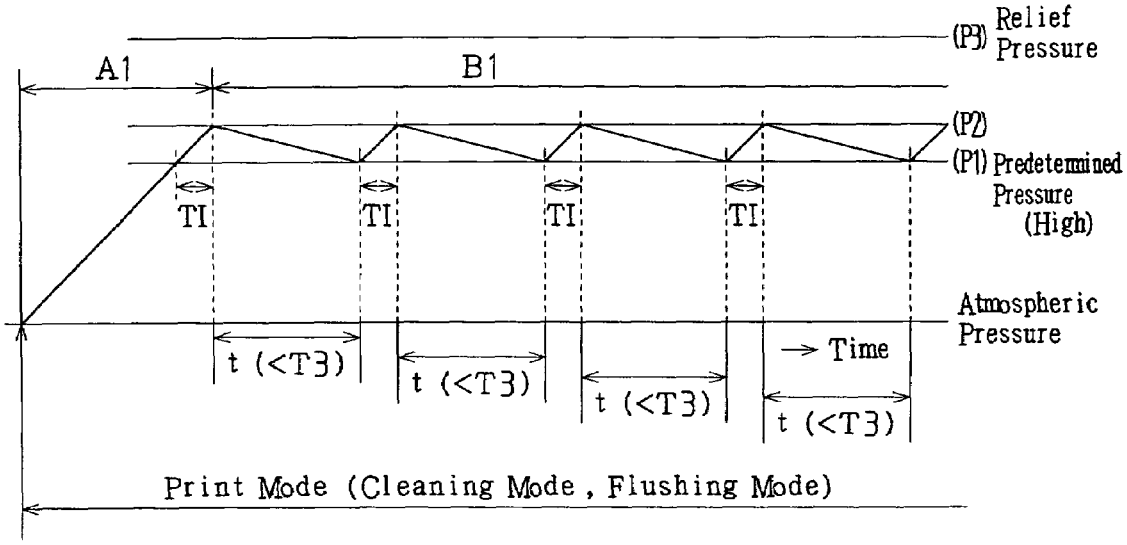
FIGS. 13(*a*) and 13(*b*) are time charts.
Figure 13B:
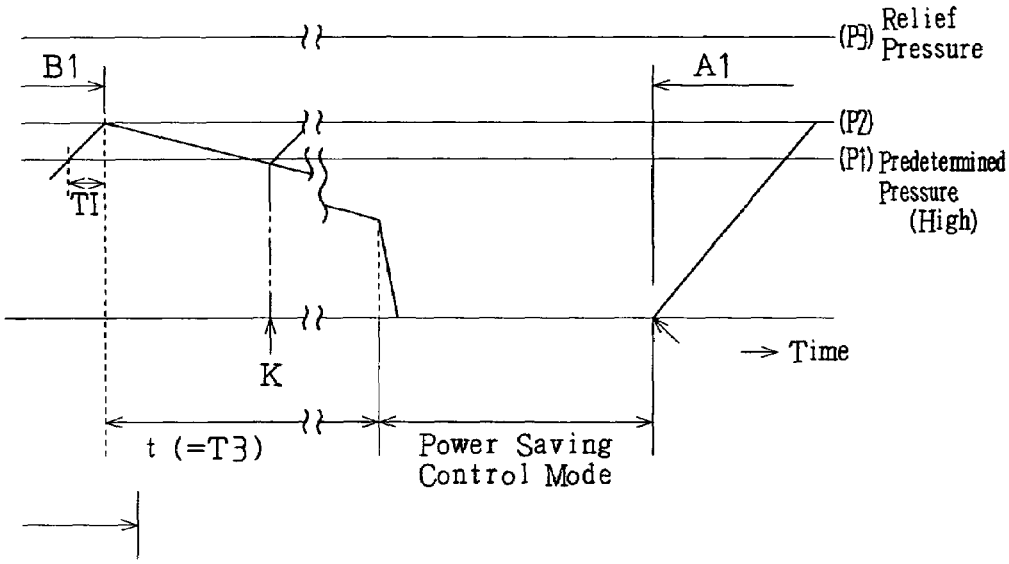

In FIG. 13(*a*), reference character Al denotes the period during which the ink cartridge pressurization program A is being executed. The ink cartridge pressurization program A is started at the same time as when the print mode (or the cleaning mode, or the flushing mode) is started and executed in parallel with the print mode. FIG. 13(*a*) shows the pressure of the air passage, which extends from the air pressurization pump 21 to each main tank 9, during period A1 based on the operation described above.

As shown in FIG. 13(*a*), the pressure of the air passage is at the value of the atmospheric pressure at the beginning of period A1, increases gradually from the atmospheric pressure value, and then exceeds the predetermined pressure P1. Subsequently, the pressure of the air passage reaches pressure P2 when the drive time T1 elapses.

When the CPU 101 determines that the continuous pressurization time (i.e., the count value kp) of the air pressurization pump 21 is greater than or equal to the pressurization time abnormality determination value T2 in step S21, the CPU 101 executes steps S22 to S24, which are shown in FIG. 10. Steps S22 to S24 are identical to steps S18 to S20 and will not be described. Through this processing, the air pressurization pump 21 is stopped, and the count value KP (present value) of the pressurization pump counter is obtained.

In this manner, when the CPU 101 determines that the count value kp is greater than or equal to the pressurization time abnormality determination value T2 while the detected pressure value is still determined as being low in step S15, it may be assumed that a failure is occurring in the pressurized air supply system. In this case, the CPU 101 displays an error message indicating that a supply error is occurring on, for example, the display (not shown) of the recording apparatus.

Figure 11:
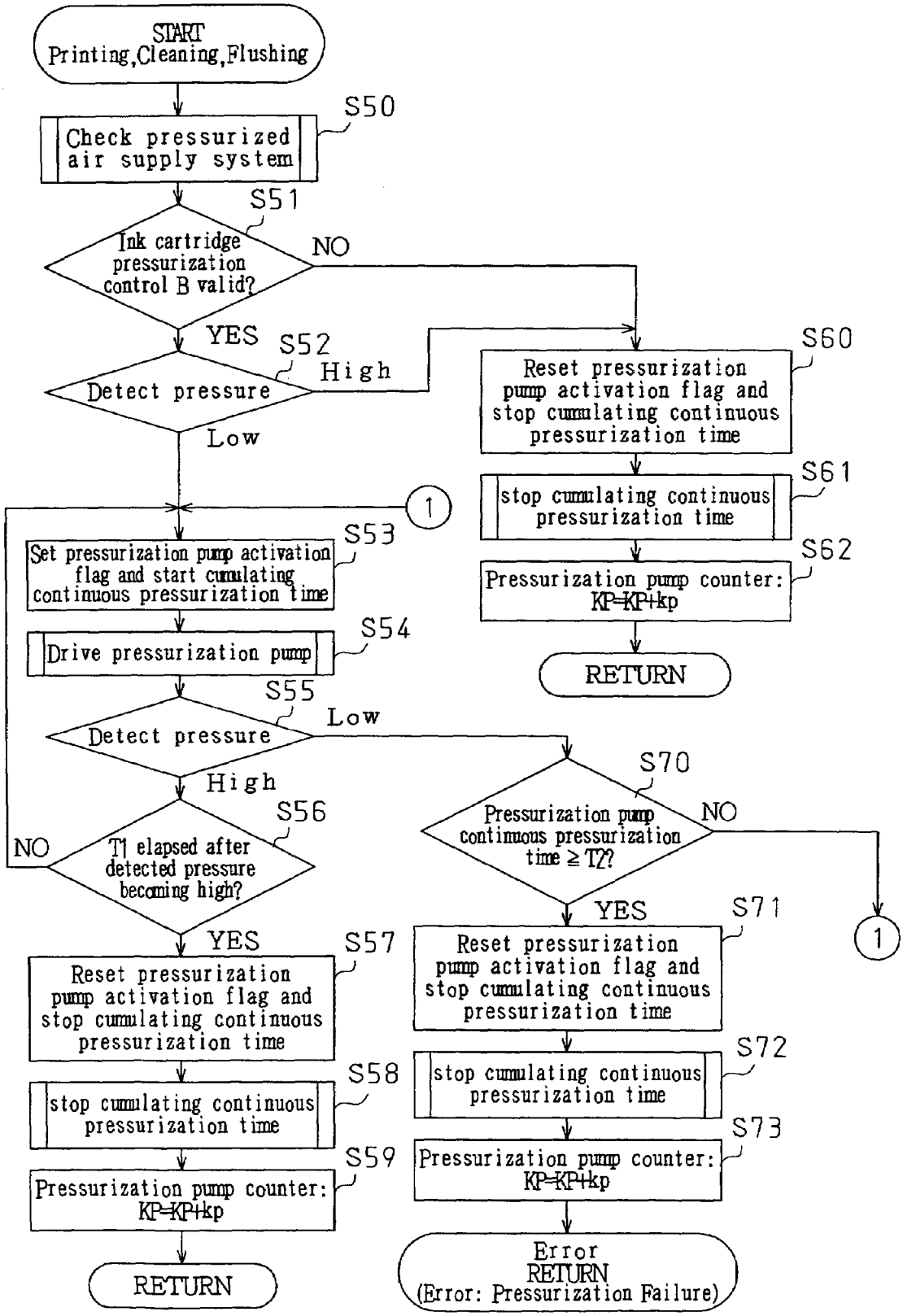
FIG. 11 is a flowchart showing a process executed by the CPU.

FIG. 11 is a flowchart showing the ink cartridge pressurization program B that is regularly executed by the CPU 101 in parallel with the print program, the cleaning program, or the flushing program. This program may be executed at time intervals of, for example, ten seconds or so. However, the present invention is not limited to such a frequency.

In step S50, the CPU 101 checks the pressurized air supply system in the same manner as in step S10 of the ink cartridge pressurization program A. In step S51, the CPU 101 determines whether the ink cartridge pressurization control B is valid based on whether the control validating flag is set. When determining that the control validating flag is not set in step S51, the CPU 101 executes steps S60 to S62. Then, the CPU 101 temporarily terminates the routine. Steps S60 to S62 are identical to steps S18 to S20 and will not be described here.

When determining that the control validating flag is set in step S51, the CPU 101 proceeds to step S52. In step S52, the CPU 101 determines whether the pressure detection value P of the detection unit 46 of the pressure detector 23 is greater than or equal to the predetermined pressure P1 (high) or smaller than the predetermined pressure P1 (low).

When the pressure detection value P is greater than or equal to the predetermined pressure P1 in step S52, the CPU 101 executes steps S60 to S62. The CPU 101 then temporarily terminates the routine. When determining that the pressure detection value P is smaller than the predetermined pressure P1 (low) in step S52, the CPU 101 proceeds to step S53.

In step S53, the CPU 101 sets the pressurization pump activation flag and starts cumulating the continuous pressurization time (i.e., the count value kp) when the entering step S53 from step S52. The CPU 101 cumulates the continuous pressurization time (i.e., the count value kp) without resetting the count value kp when entering step S53 from steps S70 or S56, which will be described later.

In step S54, the CPU 101 drives the air pressurization pump 21 with the pressurization pump motor 59. In step S55, the CPU 101 determines whether the pressure detection value P of the detection unit 46 of the pressure detector 23 is greater than or equal to the predetermined pressure P1 (high) or smaller than the predetermined pressure P1 (low).

When determining that the pressure detection value P is greater than or equal to the predetermined pressure P1 in step S55, the CPU 101 proceeds to step S56. In step S56, the CPU 101 determines whether the predetermined drive time T1 has elapsed from when the pressure value detected by the detection unit 46 of the pressure detector 23 reached the predetermined pressure P1 (high). When determining that the predetermined drive time T1 has elapsed from when detecting that the pressure detection value P has reached the predetermined pressure P1, the CPU 101 executes steps S57 to S59. The CPU 101 then temporarily terminates the routine. Steps S57 to S59 are identical to steps S60 to S62 and will not be described here.

When determining that the pressure detection value P is smaller than the predetermined pressure P1 (low) in step S55, the CPU 101 proceeds to step S70. In step S70, the CPU 101 determines whether the continuous pressurization time of the air pressurization pump 21 (i.e., the count value kp) is greater than or equal to the pressurization time abnormality determination value T2 in the same manner as in step S21. When the continuous pressurization time of the air pressurization pump 21 (i.e., the count value kp) is smaller than the pressurization time abnormality determination value T2 in step S70, the CPU 101 proceeds to step S53.

When determining that the continuous pressurization time of the air pressurization pump 21 (i.e., the count value kp) is greater than or equal to the pressurization time abnormality determination value T2 in step S70, the CPU 101 executes steps S71 to S73. Steps S71 to S73 are identical to steps S18 to S20 and will not be described here. Through this processing, the air pressurization pump 21 is stopped, and the counter value KP (present value) of the pressurization pump counter is obtained.

In FIGS. 13(*a*) and 13(*b*), reference character B1 indicates the period during which the ink cartridge pressurization program B is being executed. The ink cartridge pressurization program B is started when execution of the ink cartridge pressurization program A is completed during the print mode (or the cleaning mode or the flushing mode) and stopped at the same time as when the print mode is stopped. FIGS. 13(*a*) and 13(*b*) show the pressure of the air passage, which extends from the air pressurization pump 21 to each main tank 9, during period B1 based on the operation described above.

More specifically, during execution of the ink cartridge pressurization program A, the air pressurization pump 21 is driven when the pressure detected by the pressure detector 23 reaches the predetermined pressure P1. Further, the air pressurization pump 21 is continuously driven until the drive time T1 elapses after the detected pressure reaches the predetermined pressure P1. The air pressurization pump 21 is stopped when the drive time T1 elapses. The pressure of the air passage increases to pressure P2 and then gradually decreases as the ink is consumed by printing or other operations. When the pressure level decreases to the predetermined pressure P1, the air pressurization pump 21 is driven again continuously for the drive time T1.

With the operational sequence described above, a single driving operation of the air pressurization pump 21 enables accumulation of sufficiently high air pressure.

Steps S50 to S52 and S60 to S62 are executed before the pressure detection value P decreases from the pressure P2 to the predetermined pressure P1. Further, steps S53 to S56 are steps that are executed during the drive time T1. These steps correspond to a pressurization sequence for driving the air pressurization pump 21 (gas pressurization pump) when the pressure of the pressurized air (pressurized gas) decreases and for stopping the air pressurization pump 21 when the pressure of the pressurized air (pressurized gas) increases.

The power saving control mode will now be described.

In the present embodiment, the CPU 101 includes a timer (not shown) for measuring a stop time from when the pressurization pump motor 59 is stopped in the print mode, the cleaning mode, or the flushing mode. When the stop time t measured by the timer reaches the determination value T3, the CPU 101 shifts to the power saving control mode. If the stop time t is still smaller than the determination value T3, the timer is reset by the CPU 101 when the stopped pressurization pump motor 59 is driven again. The determination value T3 may be set at a value complying with the Energy Star standard, or may be set at another value. The stop time determination value T3 may be, for example, ten minutes or so.

In the print mode, if the CPU 101 does not receive a control signal for printing from the host computer 120 and the stop time t of the pressurization pump motor 59 exceeds the determination value T3, the CPU 101 shifts to the power saving control mode. When the stop time t of the pressurization pump motor 59 exceeds the determination value T3 in the cleaning mode or the flushing mode, the CPU 101 shifts to the power saving control mode. In the power saving control mode, only the communication control functions of the I/F 111 and the CPU 101 remain active to enable communication with the host computer 120, and the actuators (including the motors 114, 2, 59, and 115, the solenoid 91, and the recording head 6) are inactivated. This reduces power consumption of the inkjet recording apparatus.

In the present embodiment, the detection unit 46 remains activated even after shifting to the power saving control mode. This enables the pressure of the air passage to be detected and the pressure detection value P to be input to the CPU 101 even in the power saving control mode.

FIG. 13(*a*) shows an example in which the stop time t of the pressurization pump motor 59 is smaller than the stop time determination value T3. In this case, the stop time t is less than the stop time determination value T3. Thus, the CPU 101 does not shift to the power saving control mode. FIG. 13(*b*) shows an example in which period B1 has ended and the air pressurization pump 21 has stopped thus resulting in gradual decrease of the air pressure. In this case, when the stop time t of the pressurization pump motor 59 reaches the stop time determination value T3, the CPU 101 shifts to the power saving control mode. More specifically, the CPU 101 de-energizes the solenoid 91 and opens the diaphragm valve 82, which functions as the relief valve, when the stop time t reaches the stop time determination value T3. As a result, the air pressure of the air passage decreases to the atmospheric pressure. When the print mode (or the cleaning mode or the flushing mode) is started and the power saving control mode is terminated, the ink cartridge pressurization program A is started at the same time. As a result, the pressurization pump motor 59 is driven thereby increasing the air pressure of the air passage.

In FIG. 13(*b*), if the stop time t is smaller than or equal to the stop time determination value T3 and the air pressure of the air passage is smaller than or equal to the predetermined pressure P1, the CPU 101 shifts to the print mode etc. at timing K in response to a control signal, such as a print command provided from the host computer 120. In this case, the pressurization pump motor 59 is driven at timing K. Further, the pressure detection value P of the detection unit 46 has already been input to the CPU 101. Thus, the CPU 101 immediately executes the ink cartridge pressurization program A and increases the air pressure based on the pressure detection value P. As a result, the air pressure of the air passage starts increasing at timing K.

In the inkjet recording apparatus of the present embodiment and the control method of the present embodiment, if the air pressurization pump 21 is not driven and the stop time t of the air pressurization pump 21 exceeds the stop time determination value T3 when a drive control mode such as the print mode, the cleaning mode, and the flushing mode is not being executed, the CPU 101 shifts to the power saving control mode. The pressurization sequence is not executed when the stop time t is being measured for comparison with the stop time determination value T3.

In this manner, the inkjet recording apparatus and the control method of the present embodiment enable the shift to the power saving control mode. The air pressurization pump 21 is not driven when ink does not need to be ejected. This structure extends the life of the air pressurization pump 21. Further, this structure eliminates wasteful power consumption caused by unnecessarily driving of the air pressurization pump 21 and improves the power saving effect of the inkjet recording apparatus.

In the present embodiment, when the pressure detector 23 detects that the pressure of the pressurized air of the air passage reaches the predetermined pressure P1, that is, when the pressure of the pressurized air of the air passage decreases and reaches the predetermined pressure P1, the air pressurization pump 21 is driven. As a result, the air pressurization pump 21 is driven whenever the pressure of the pressurized air decreases and reaches the predetermined pressure P1. In other words, the air pressurization pump 21 is driven intermittently. The operation time of the air pressurization pump 21 is shorter as compared with when the air pressurization pump 21 is driven constantly. This structure extends the life of the air pressurization pump 21. Further, this structure enables the pressure of the pressurized air to be held to be greater than or equal to the predetermined pressure P1.

In the present embodiment, the pressure release valve 22 for releasing the air pressure is inactivated during the power saving control mode. More specifically, the solenoid 91 is de-energized in the power saving control mode. This eliminates wasteful power consumption and improves the power saving effect of the inkjet recording apparatus.

Second Embodiment

A second embodiment of the present invention will now be described with reference to FIGS. 14(*a*) and 14(*b*). Like or same reference numerals are given to those components that are the same as the corresponding components of the first embodiment, and will not be described in detail. The second embodiment will be described focusing on its differences from the first embodiment.

The second embodiment differs from the first embodiment in that the CPU 101 includes a timer for measuring a sealing time t1 instead of the timer for measuring the stop time t. The sealing time t1 is the time during which the capping unit 11 seals the recording head 6. When the sealing time t1 measured by the timer reaches a sealing time determination value T4, the CPU 101 shifts to the power saving control mode.

The sealing time determination value T4 is, for example, ten minutes or so. The sealing time determination value T4 may be set at a value complying with the Energy Star standard or may be set at another value.

When the print mode is completed, the CPU 101 moves the carriage 1 to the home position so that the cap member 11*a* seals the nozzle surface of the recording head 6. The timer starts measuring the sealing time t when the cap member 11*a* seals the nozzle surface. When the sealing time t1 measured by the timer reaches the sealing time determination value T4, the CPU 101 shifts to the power saving control mode.

In the power saving control mode, only the communication control functions of the I/F 111 and the CPU 101 remain active to enable communication with the host computer 120. The actuators (including the motors 114, 2, 59, and 115, the solenoid 91, and the recording head 6) are inactivated in the same manner as in the first embodiment. This reduces power consumption of the inkjet recording apparatus.

In the second embodiment, the detection unit 46 remains activated in the power saving control mode in the same manner as in the first embodiment. This enables the pressure of the air passage to be detected and the pressure detection value P to be input to the CPU 101 even in the power saving control mode.

Figure 14A:
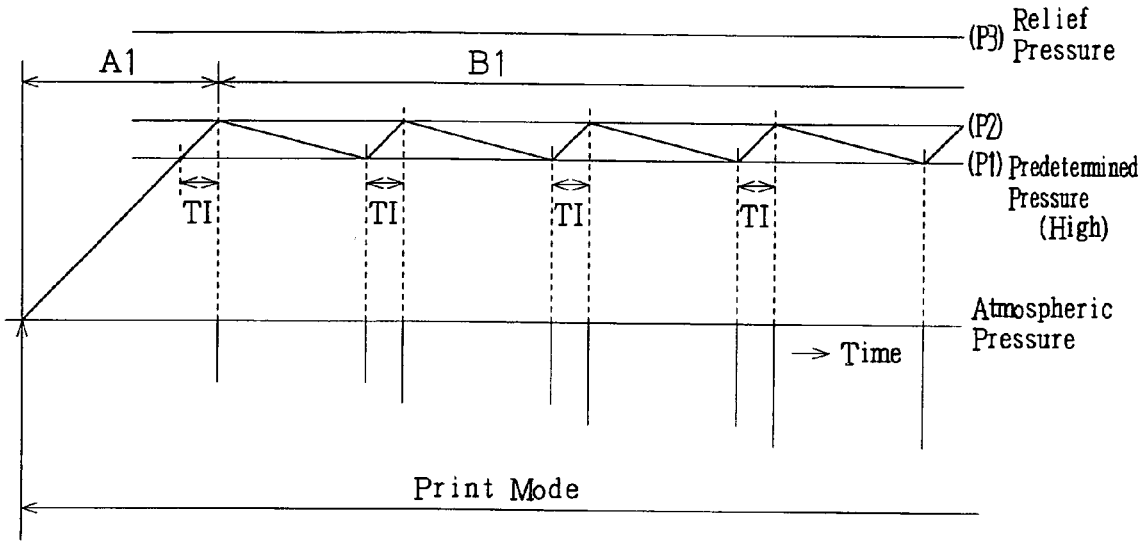
FIGS. 14(*a*) and 14(*b*) are time charts according to a second embodiment of the present invention.
Figure 14B:
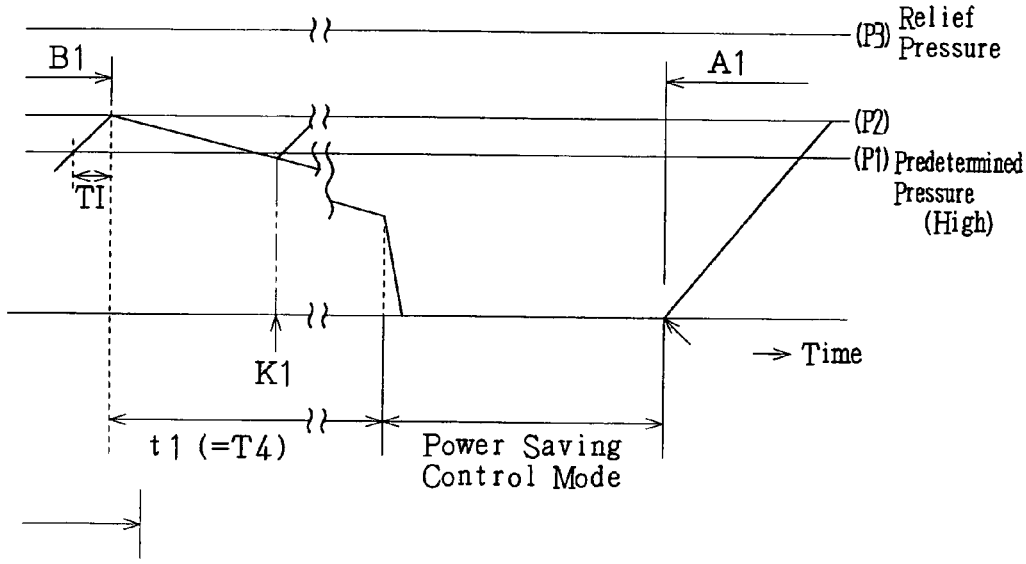

FIG. 14(*a*) shows the pressure in the air passage, which changes after the air pressurization pump 21 is activated during execution of the ink cartridge pressurization program A. As shown in FIG. 14(*a*), in the print mode, the air pressurization pump 21 is driven when the pressure detected by the pressure detector 23 reaches the predetermined pressure P1. The air pressurization pump 21 is continuously driven until the drive time T1 elapses. The air pressurization pump 21 is stopped when the drive time T1 elapses. Subsequently, when the pressure decreases and the pressure of the pressurized air of the air passage reaches the predetermined pressure P1, the air pressurization pump 21 is driven again in the same manner as in the first embodiment. As a result, the air pressurization pump 21 is driven whenever the pressure of the pressurized air decreases to the predetermined pressure P1. In other words, the air pressurization pump 21 is driven intermittently.

FIG. 14(*b*) shows an example in which period B1 ends and the air pressurization pump 21 is stopped thus resulting in gradual decrease of the air pressure. In this case, when the sealing time t1 reaches the sealing time determination value T4, the CPU 101 shifts to the power saving control mode. More specifically, the CPU 101 de-energizes the solenoid 91 and opens the diaphragm valve 82 when the sealing time t1 reaches the sealing time determination value T4. As a result, the air pressure of the air passage decreases to the atmospheric pressure. When the print mode is started and the power saving control mode ends, the ink cartridge pressurization program A is started at the same time. As a result, the pressurization pump motor 59 is driven thereby increasing the air pressure of the air passage.

In FIG. 14(*b*), if the sealing time t1 is still smaller than the sealing time determination value T4 and the air pressure of the air passage is smaller than or equal to the predetermined pressure P1 (at timing K1), the CPU 101 shifts to the print mode in response to a control signal, such as a print command provided from the host computer 120. In this case, the pressurization pump motor 59 is driven at timing K1. Since the pressure detection value P of the detection unit 46 has already been input in the CPU 101, the CPU 101 immediately executes the ink cartridge pressurization program A to increase the air pressure based on the pressure detection value P. As a result, the air pressure of the air passage starts to increases at this point in time.

In the inkjet recording apparatus of the second embodiment, the air pressurization pump 21 is not driven when the print mode is not being executed, and the CPU 101 shifts to the power saving control mode when the sealing time t1 reaches the sealing time determination value T4, which corresponds to a predetermined time. The pressurization sequence is not executed when the sealing time t1 is being measured for comparison with the sealing time determination value T4.

In this manner, the inkjet recording apparatus of the second embodiment also enables the shift to the power saving control mode. Thus, the air pressurization pump 21 is not driven when the ink does not need to be ejected. This structure extends the life of the air pressurization pump 21. Further, this structure eliminates wasteful power consumption caused by unnecessary driving of the air pressurization pump 21 and improves the power saving effect of the inkjet recording apparatus.

It should be apparent to those skilled in the art that the present invention may be embodied in many other specific forms without departing from the spirit or scope of the invention. Particularly, it should be understood that the present invention may be embodied in the following forms.

In the above embodiments, the inkjet recording apparatus receives an input of a print command etc. provided from the host computer. However, the present invention is not limited to such a structure. For example, the CPU 101 may include a PC card I/F so as to enable use of a storage medium, such as a memory card, via a PC card adapter. The PC card I/F enables information, such as image data, to be read from and written to a storage medium, such as a memory card. By using such an I/F, the CPU 101 may receive image data from the PC card without being connected to the host computer 120.

In the above embodiments, in the power saving control mode, only the communication control functions of the I/F 111 and the CPU 101 remain active to enable communication with the host computer 120. Further, the actuators (including the motors 114, 2, 59, and 115, the solenoid 91, and the recording head 6) are inactivated. In addition, the clock frequency of the CPU 101 may be lowered in the power saving control mode.

The present examples and embodiments are to be considered as illustrative and not restrictive, and the invention is not to be limited to the details given herein, but may be modified within the scope and equivalence of the appended claims.

The invention claimed is:

1. A method for controlling a liquid ejection apparatus that supplies liquid stored in a tank to a liquid ejection head arranged on a carriage by applying pressurized gas pressure to the tank, the method comprising:

performing a pressurization sequence for operating a gas pressurization pump when the pressurized gas pressure applied to the tank decreases and for stopping the operation of the gas pressurization pump when the pressurized gas pressure increases;

selectively setting a drive control mode and a power save control mode, wherein the drive control mode supplies the liquid from the tank to the liquid ejection head by applying the pressurized gas pressure to the tank through the pressurization sequence, and the power saving control mode consumes less power than the drive control mode; and shifting to the power saving control mode when a predetermined time elapses after the drive control mode ends and stops operating the gas pressurization pump, without the gas pressurization pump being operated by the pressurization sequence until the predetermined time elapses.

2. The method according to claim 1, wherein the pressurization sequence includes:

detecting the pressurized gas pressure with a pressure detector; and operating the gas pressurization pump when the pressure detector detects that the pressurized gas pressure has decreased to a predetermined pressure so as to maintain the pressurized gas pressure at the predetermined pressure or greater.

3. The method according to claim 1, wherein:

the drive control mode includes supplying a pressure releasing unit with power, in which the pressure releasing unit is capable of releasing the pressurized gas pressure into the atmosphere, wherein the supply of power to the pressure releasing unit disables pressure release of the pressurized gas; and the power saving control mode includes stopping the supply of power to the pressure releasing unit so as to enable pressure release of the pressurized gas pressure with the pressure releasing unit.

4. The method according to claim 2, further comprising:

supplying the pressure detector with power to enable detection of the pressurized gas pressure with the pressure detector when the drive control mode ends until a predetermined time elapses from when the drive control mode ends and stops operating the gas pressurization pump.

5. A method for controlling a liquid ejection apparatus that supplies liquid stored in a tank to a liquid ejection head arranged on a carriage by applying pressurized gas pressure to the tank, in which the liquid ejection apparatus includes a capping unit for sealing the liquid ejection head when necessary, the method comprising:

performing a pressurization sequence for operating a gas pressurization pump when the pressurized gas pressure applied to the tank decreases and for stopping the operation of the gas pressurization pump when the pressurized gas pressure increases;

selectively setting a drive control mode and a power save control mode, wherein the drive control mode supplies the liquid from the tank to the liquid ejection head by applying the pressurized gas pressure to the tank through the pressurization sequence, and the power saving control mode consumes less power than the drive control mode; and shifting to the power saving control mode when a predetermined time elapses after the drive control mode ends and the capping unit seals the liquid ejection head, without the gas pressurization pump being operated by the pressurization sequence until the predetermined time elapses.

6. The method according to claim 5, wherein the pressurization sequence includes:

detecting the pressurized gas pressure with a pressure detector; and operating the gas pressurization pump when the pressure detector detects that the pressurized gas pressure has decreased to a predetermined pressure so as to maintain the pressurized gas pressure at the predetermined pressure or greater.

7. The method according to claim 5, wherein:

the drive control mode includes supplying a pressure releasing unit with power, in which the pressure releasing unit is capable of releasing the pressurized gas pressure into the atmosphere, wherein the supply of power to the pressure releasing unit disables the pressure release of the pressurized gas; and the power saving control mode includes stopping the supply of power to the pressure releasing unit so as to enable pressure release of the pressurized gas pressure with the pressure releasing unit.

8. The method according to claim 6, further comprising:

supplying the pressure detector with power to enable detection of the pressurized gas pressure with the pressure detector when the drive control mode ends until a predetermined time elapses from when the drive control mode ends and stops operating the gas pressurization pump.

9. A liquid ejection apparatus comprising:

a tank for storing liquid;

a gas pressurization pump for applying pressurized gas pressure to the tank;

a liquid ejection head arranged on a carriage; and a controller for controlling the supply of the liquid to the liquid ejection head from the tank, the controller:

performing a pressurization sequence for operating the gas pressurization pump when the pressurized gas pressure decreases and for stopping the operation of the gas pressurization pump when the pressurized gas pressure increases;

selectively setting a drive control mode and a power save control mode, wherein the drive control mode supplies the liquid from the tank to the liquid ejection head by applying the pressurized gas pressure to the tank through the pressurization sequence, and the power saving control mode consumes less power than the drive control mode; and shifting to the power saving control mode when a predetermined time elapses after the drive control mode ends and stops operating the gas pressurization pump, without the gas pressurization pump being operated by the pressurization sequence until the predetermined time elapses.

10. The liquid ejection apparatus according to claim 9, further comprising:

a pressure detector for detecting the pressurized gas pressure, wherein the controller operates the gas pressurization pump when the pressure detector detects that the pressurized gas pressure has decreased to a predetermined pressure so as to maintain the pressurized gas pressure at the predetermined pressure or greater.

11. The liquid ejection apparatus according to claim 10, further comprising:

a pressure releasing unit for enabling the pressurized gas pressure to be released into the atmosphere, wherein the controller supplies the pressure releasing unit with power so as to disable the pressure release of the pressurized gas, and the controller stops the supply of power to the pressure releasing unit so as to enable pressure release of the pressurized gas pressure with the pressure releasing unit.

* * * * *